US011170908B2

(12) United States Patent
Fossum et al.

(10) Patent No.: US 11,170,908 B2
(45) Date of Patent: Nov. 9, 2021

(54) CABLE COMPRISING A SILANE CROSSLINKABLE POLYMER COMPOSITION

(71) Applicant: BOREALIS AG, Vienna (AT)

(72) Inventors: Kjell Fossum, Stenungsund (SE); Martin Anker, Hisings Kärra (SE); Mattias Bergqvist, Gothenburg (SE); Kristian Dahlen, Stora Höga (SE); Thomas Hjertberg, Kungshamn (SE); Perry Nylander, Gothenburg (SE); Ola Fagrell, Stenungsund (SE)

(73) Assignee: BOREALIS AG, Vienna (AT)

( * ) Notice: Subject to any disclaimer, the term of this patent is extended or adjusted under 35 U.S.C. 154(b) by 0 days.

(21) Appl. No.: 15/890,824

(22) Filed: Feb. 7, 2018

(65) Prior Publication Data

US 2018/0226173 A1 Aug. 9, 2018

Related U.S. Application Data

(62) Division of application No. 14/241,356, filed as application No. PCT/EP2012/066536 on Aug. 24, 2012, now abandoned.

(30) Foreign Application Priority Data

Aug. 26, 2011 (EP) ..... 11178997

(51) Int. Cl.

| | |
|---|---|
| ***H01B 3/18*** | (2006.01) |
| ***H01B 3/44*** | (2006.01) |
| ***H01B 13/06*** | (2006.01) |
| *H01B 13/16* | (2006.01) |
| *H01B 13/18* | (2006.01) |
| *B05D 7/20* | (2006.01) |

(52) U.S. Cl.

CPC ..... *H01B 3/18* (2013.01); *H01B 3/441* (2013.01); *H01B 13/06* (2013.01); *B05D 7/20* (2013.01); *H01B 13/16* (2013.01); *H01B 13/18* (2013.01); *Y10T 428/2962* (2015.01)

(58) Field of Classification Search

CPC ..... B05D 7/20; B29C 47/0014; H01B 13/16; H01B 13/18; H01B 13/441; H01B 13/06; Y10T 428/2962

USPC ..... 427/117–120

See application file for complete search history.

(56) References Cited

U.S. PATENT DOCUMENTS

| | | | | |
|---|---|---|---|---|
| 4,297,310 | A | 10/1981 | Akutsu et al. | |
| 4,351,876 | A | 9/1982 | Doi et al. | |
| 4,397,981 | A | 8/1983 | Doi et al. | |
| 4,413,066 | A | 11/1983 | Isaka et al. | |
| 4,446,283 | A * | 5/1984 | Doi | C08F 10/00 525/326.5 |
| 4,456,704 | A | 6/1984 | Fukumura et al. | |
| 6,100,339 | A * | 8/2000 | Watanabe | C08F 232/00 524/554 |
| 6,284,374 | B1 * | 9/2001 | Yamazaki | B32B 7/06 174/105 SC |
| 8,076,439 | B2 * | 12/2011 | Matsushita | C08G 65/336 156/60 |
| 2001/0003608 | A1 | 6/2001 | Mang et al. | |
| 2003/0050401 | A1 * | 3/2003 | Jackson | C08F 255/02 525/191 |
| 2003/0132017 | A1 | 7/2003 | Barioz | |
| 2006/0101754 | A1 | 5/2006 | Risi | |
| 2010/0160571 | A1 * | 6/2010 | Alric | C08F 8/00 525/337 |
| 2010/0227966 | A1 * | 9/2010 | Jackson | C08L 51/06 524/506 |
| 2010/0263903 | A1 * | 10/2010 | Hjertberg | C08K 5/0008 174/102 SC |
| 2011/0124791 | A1 * | 5/2011 | Sultan | H01B 7/295 524/425 |
| 2011/0284260 | A1 * | 11/2011 | Smedberg | H01B 3/441 174/120 SR |
| 2013/0012667 | A1 * | 1/2013 | Hansen | C09J 183/12 525/477 |

FOREIGN PATENT DOCUMENTS

| | | | |
|---|---|---|---|
| EP | 1524292 | A1 | 4/2005 |
| EP | 1939256 | A1 | 7/2008 |
| EP | 1985666 | A1 | 10/2008 |
| EP | 2075281 | A1 | 7/2009 |
| JP | 2004-025102 | * | 1/2004 |
| JP | 2004025102 | A | 1/2004 |
| WO | 2006101754 | A1 | 9/2006 |
| WO | 2007094273 | A1 | 8/2007 |
| WO | WO 2009/059670 | * | 5/2009 |

OTHER PUBLICATIONS

International Search Report and Written Opinion dated Sep. 20, 2013 (PCT/EP2012/066536); ISA/EP.

IPRP Chapter II dated Jul. 30, 2013 (PCT/EP2012/066536); ISA/EP.

* cited by examiner

*Primary Examiner* — Brian K Talbot

(74) *Attorney, Agent, or Firm* — Banner & Witcoff, Ltd.

(57) ABSTRACT

A process of making a cable having a conductor surrounded by at least one crosslinkable layer having a polymer composition. The polymer composition has (a) a polyolefin bearing hydrolysable silane groups and a silanol condensation catalyst compound.

17 Claims, No Drawings

CABLE COMPRISING A SILANE CROSSLINKABLE POLYMER COMPOSITION

The present invention relates to a cable comprising a polymer composition comprising a polyolefin bearing hydrolysable silane groups and a silanol condensation catalyst, to the preparation process of a cable comprising said composition, the process including a silane-crosslinking step of at least the layer comprising the polymer composition and to a use of said polymer composition for producing a cable.

In wire and cable (W&C) applications a typical cable comprises a conductor surrounded by one or more layers of polymeric materials. The cables are commonly produced by extruding the layers on a conductor. One or more of said layers are often crosslinked to improve i.a. deformation resistance at elevated temperatures, as well as mechanical strength and/or chemical resistance, of the layer(s) of the cable.

Crosslinking of the polymers can be effected e.g. by free radical reaction using irradiation or using a crosslinking agent which is a free radical generating agent; or via hydrolysable silane groups present in the polymer using a condensation catalyst in the presence of water.

Power cable is defined to be a cable transferring energy operating at any voltage level. The voltage applied to the power cable can be alternating (AC), direct (DC) or transient (impulse). Moreover, power cables are typically indicated according to their level of operating voltage, e.g. a low voltage (LV), a medium voltage (MV), a high voltage (HV) or an extra high voltage (EHV) power cable, which terms are well known. Power cable is defined to be a cable transferring energy operating at any voltage level, typically operating at voltage higher than 100 V. LV power cable typically operates at voltages of below 3 kV. MV and HV power cables operate at higher voltage levels and in different applications than LV cables. A typical MV power cable, usually operates at voltages from 3 to 36 kV, and a typical HV power cable at voltages higher than 36 kV. EHV power cable operates at voltages which are even higher than typically used for HV power cable applications. LV power cable and in some embodiment medium voltage (MV) power cables usually comprise an electric conductor which is coated with an insulation layer. Typically MV and HV power cables comprise a conductor surrounded at least by an inner semiconductive layer, an insulation layer and an outer semiconductive layer, in that order.

Silane cured materials are used today primarily as insulation layer in low voltage cables and as insulation and semiconductive layer in medium and to some extent also for high voltage cables.

In case the polymer composition is crosslinkable via hydrolysable silane groups, then the hydrolysable silane groups may be introduced into the polymer by copolymerisation of a monomer, e.g. an olefin, together with a silane group containing comonomer or by grafting silane groups containing compound to a polymer. Grafting is a chemical modification of the polymer by addition of silane groups containing compound usually in a radical reaction. Such silane groups containing comonomers and compounds are well known in the field and e.g. commercially available. The hydrolysable silane groups are typically then crosslinked by hydrolysis and subsequent condensation in the presence of a silanol condensation catalyst and $H_2O$ in a manner known in the art. Silane crosslinking techniques are known and described e.g. in U.S. Pat. Nos. 4,413,066, 4,297,310, 4,351,876, 4,397,981, 4,446,283 and 4,456,704.

For crosslinking of polyolefins containing hydrolysable silane groups, a silanol condensation catalyst must be used. Conventional catalysts are, for example, tin-, zinc-, iron-, lead- or cobalt-organic compounds such as dibutyl tin dilaurate (DBTDL). However, it is known that DBTDL has a negative impact on the natural environment when the crosslinked products, such as cables, are installed in the ground. Furthermore, is also a hazardous material to work with.

EP1985666 (WO2007094273) discloses a non-organotin curable composition comprising a (a) silyl group containing polymer, (b) an amidine compound as a condensation catalyst and (c) a carboxylic acid as a crosslinking booster, wherein the mole ratio of (b) of all nitrogen atoms to (c) of all carboxy groups is higher than 2. The composition is stated for use as a sealant, adhesive, coating or a rubber like cured product.

US20030132017 (EP1306392) discloses a process for producing a cable layer by extruding and crosslinking a polymer composition comprising a silane grafted base polymer. The crosslinking is effected in the presence of a secondary amine group containing compound which acts as crosslinking catalyst. It is stated that in the presence of the compound the polymer composition "self-crosslinks" without needing any humidity other than the ambient humidity. Accordingly the step of crosslinking in water bath or sauna can be avoided.

WO2006101754 describes a moisture crosslinkable polymer composition comprising silane functionalised polyolefin, an acidic silanol condensation catalyst (e.g. organic sulphonic acid) and antioxidant which is a secondary amine substituted with two aromatic ligands.

EP1524292 describes a process for crosslinking a silane grafted polymer composition in the presence of water and a condensation catalyst which is an amine having molecular weight more than 2000 g/mol. Preferred amines are polyamino based polymers.

It is hence an object of the present invention to provide a further silanol condensation catalyst for a polymer composition comprising a polyolefin bearing hydrolysable silane groups, which avoids the drawbacks of tin based condensation catalysts, i.e. which is more environmentally friendly and less hazardous to work with.

DESCRIPTION OF THE INVENTION

It has now surprisingly been found that basic compounds can be used for hydrolysation and subsequent condensation of a silane containing polymer, i.e. as a crosslinking catalyst, in demanding wire and cable (W&C) applications. Unexpectedly, the condensation catalysts of the invention meet the requirements set for the crosslinking efficiency without adversing the electrical properties, like conductivity requirements, requested in demanding cable applications. The silanol condensation catalysts of the invention are industrially highly advantageous for silane crosslinking of a polymer composition in layer(s) of a cable in order to obtain silane-crosslinked cable.

Accordingly, the present invention provides a cable comprising a conductor surrounded by at least one layer comprising, preferably consisting of, a polymer composition which comprises (a) a polyolefin bearing hydrolysable silane groups and (b) a silanol condensation catalyst compound, wherein the silanol condensation catalyst (b) is an organic compound which comprises at least one nitrogen atom containing moiety, wherein said nitrogen atom containing moiety is other than a secondary amine moiety and wherein the organic compound has a molecular weight of less than 2000 g/mol.

The molecular weight of less than 2000 g/mol is based on the atom weight.

The term "cable" means cables and wires.

The polymer composition of the invention as defined above or below is referred herein also shortly as "polymer composition". As to the components of the polymer composition, the polyolefin bearing hydrolysable silane groups (a) is referred herein also shortly as "polyolefin (a)" and the silanol condensation catalyst compound (b) is referred herein also shortly as "catalyst (b)".

Moreover, the catalyst (b) can be present in the polymer composition before or after the formation of the cable layer.

The preferable cable comprises a conductor surrounded by at least one layer which is selected from an insulation layer, a semiconductive layer or a jacketing layer. More preferably, said at least one layer is an insulation layer.

Even more preferably, the cable is a power cable comprising a conductor surrounded at least by an inner semiconductive layer, an insulating layer and an outer semiconductive layer, wherein at least one layer, preferably at least the insulation layer or at least one of the inner and outer semiconductive layer, preferably at least the insulation layer, comprises, preferably consists of, the polymer composition which comprises (a) a polyolefin bearing hydrolysable silane groups and (b) a silanol condensation catalyst compound, wherein the silanol condensation catalyst (b) is an organic compound which comprises at least one nitrogen atom containing moiety, wherein said nitrogen atom containing moiety is other than a secondary amine moiety and wherein the organic compound has a molecular weight of less than 2000 g/mol.

Naturally, the polymer composition may comprise two or more catalysts (b). Also naturally, in addition to the nitrogen atom containing moiety the catalyst (b) may comprise further nitrogen containing moiety/moieties.

Preferably the cable is crosslinkable and is subsequently crosslinked before the end use. "Crosslinkable" means that the polymer composition can be silane-crosslinked using the catalyst (b) before the cable is used in the end application thereof.

The following preferable embodiments, properties and subgroups of the polyolefin (a) and the catalyst (b), of the polymer composition and of the cable are independently generalisable so that they can be used in any order or combination to further define the preferable embodiments of the polymer composition and the cable, of the invention. Moreover, unless otherwise stated, it is evident that the given polyolefin (a) description applies to the polyolefin prior optional crosslinking.

Silanol Condensation Catalyst (Catalyst (b))

Catalyst (b) is an organic compound as defined above, below or in claims which catalyses the crosslinking of silane groups via hydrolysis and subsequent condensation reaction in the presence of said catalyst (b).

The organic compound as said catalyst (b) comprises a hydrocarbyl moiety.

The molecular weight of the catalyst (b) is preferably 1800 g/mol or less, preferably 1500 g/mol or less, more preferably 30 to 1000 g/mol, even more preferably 50 to 800 g/mol, more preferably 50 to 500 g/mol.

The catalyst (b) suitable for the polymer composition present at least in one layer of the cable of the invention is more preferably selected from a compound of formula (I)

$$R^4R^3N—CR^2{=}NR^1 \quad \text{(I) (also referred as compound (I));}$$

wherein $R^1$, $R^2$, $R^3$ and $R^4$ each independently is a hydrogen or a substituted or unsubstituted saturated or partially unsaturated hydrocarbyl group which optionally contains one or more heteroatom(s); a substituted or unsubstituted aromatic hydrocarbyl group which optionally contains one or more heteroatom(s); or any two of $R^1$, $R^2$, $R^3$ and $R^4$ together with the atom they are attached to form a substituted or unsubstituted ring system which is optionally fused with one or more other rings and optionally contains one or more heteroatom(s); provided that at least one of $R^1$, $R^2$, $R^3$ and $R^4$ is other than H;

a compound of formula (II)

$$R^4R^3N—CR^2{=}CR^1R^5 \quad \text{(II) (also referred as compound (II)),}$$

formula (I) wherein $R^1$, $R^2$, $R^3$, $R^4$ and $R^5$ each independently is a hydrogen or a substituted or unsubstituted saturated or partially unsaturated hydrocarbyl group which optionally contains one or more heteroatom(s); a substituted or unsubstituted aromatic hydrocarbyl group which optionally contains one or more heteroatom(s); or any two of $R^1$, $R^2$, $R^3$, $R^4$ and $R^5$ together with the atom they are attached to form a substituted or unsubstituted ring system which is optionally fused with one or more other rings and optionally contains one or more heteroatom(s); provided that at least one of $R^1$, $R^2$, $R^3$, $R^4$ and $R^5$ is other than H; or a compound which is other than the compound (I) or compound (II) and which comprises a saturated or partially unsaturated hydrocarbyl or aromatic hydrocarbyl moiety, wherein said saturated or partially unsaturated hydrocarbyl moiety or aromatic hydrocarbyl moiety optionally contains one or more heteroatom(s) and wherein the compound bears at least two amine substituents which are independently selected from primary or secondary amine substituents and optionally further substitutent(s), provided that at least one of the two amine substituents is other than a secondary amine substituent (also referred as compound (III));

whereby each of the compound of formula (I), (II) or (III) has a molecular weight of less than 2000.

It is evident for a skilled person that the presence or absence of any of the substituents $R^1$, $R^2$, $R^3$, $R^4$ and, resp., $R^5$ of the above formula (I) and (II) depend on the valency of the atom they are attached to.

A hydrocarbyl group can be linear, branched or cyclic or a mixture of cyclic and linear or branched groups. For the avoidance of doubt, the term "hydrocarbyl" used herein does not mean aromatic cyclic groups as is clear from the definitions used herein, i.e. aromatic cyclic groups are defined as aromatic hydrocarbyl. The expression "partially unsaturated" means that the moiety may comprise one or more double or triple bonds and includes alkenyl radicals comprising at least one double bond and alkynyl radicals comprising at least one triple bond. In case of "partially unsaturated cyclic hydrocarbyl" there can be one or more double bonds in the ring systems meaning that the ring is non-aromatic to differentiate said "partially unsaturated" ring moieties from "aromatic rings" such as phenyl or pyridyl radicals.

The expression "monocyclic" includes monocyclic ring systems, such as cyclopentyl, cyclohexyl, cycloheptyl or phenyl. The expression "multicyclic" means herein fused ring systems, including the bicyclic rings, such as naphthyl.

The term "optional" in compound (I), (II) or (III) means "may or may not be present", e.g. "optionally substituted" covers the possibilities that a substituent is present or is not present. The term "unsubstituted" naturally means that no substituent is present.

Furthermore, the "optional heteroatom(s)" which may be present in any of the substituents, as moieties in the substituents or in ring system formed by two substitutents in the above formulae (I), (II) and (III) as defined above or below are independently selected from N, O, P or S, preferably N, O or S, more preferably N or O. N, P or S can be present as oxides, such as $SO_2$. The position of the heteroatom(s) is not limited. A hydrocarbyl substituent which contains heteroatom(s) may for instance be linked to the backbone of the compound (I), (II) or (III) via a heteroatom, or such hydrocarbyl substituent may be interrupted by one or more heteroatom(s). For instance N or O, if present in the hydrocarbyl substituent, can interrupt the hydrocarbyl moiety of the compound (I), (II) or (III) (e.g. be present as —NX—, wherein X denotes H or a hydrocarbyl group as defined above or below, or as —O—), or the hydrocarbyl substituent is linked to the backbone of the compound (I), (II) or (III) via the N or O atom, i.e. the hydrocarbyl substituent is —N═Y, —NH—Y or —$N(Y)_2$, wherein each Y moiety denotes independently the rest of said hydrocarbyl substituent other than H (which may further contain a heteroatom(s), such as O, interrupting the hydrocarbyl group). It is noted herein that the hydrocarbyl containing one or more heteroatoms are often named in organic chemistry (e.g. as in well known IUPAC nomenclature system) according to their functionality, e.g. the above N and O containing hydrocarbyls are defined as amines or imines (herein containing at least one hydrocarbyl moiety) and, respectively, ethers or e.g. alkoxy or alkylalkoxy groups). However, herein the heteroatoms interrupting the hydrocarbyl substituent or linking the hydrocarbyl substituent to the backbone compound are included on purpose under the meaning of "hydrocarbyl group" to emphasize that there must be at least one hydrocarbyl moiety present in such hydrocarbyl substituents of compound (I), (II) or (III). Similarly, the specifically mentioned "at least one nitrogen atom containing moiety", "primary amine", "secondary amine" and the depicted N-containing core moieties in formulae (I-III) of the catalyst (b) are used to emphasise the functionality of these specific groups, since it is believed, without binding to any theory, that the specified group has a catalysing effect to cause the silane-crosslinking. Accordingly, any hydrocarbyl substituent containing N-atom is understood to be other (further) moiety than the above mentioned "at least one nitrogen atom containing moiety", "primary amine" and "secondary amine" present in the organic compound and, respectively, in the core moiety of compounds (I), (II) and (III) including the preferable subgroups thereof. The number of heteroatom(s), if present, in a hydrocarbyl group is preferably 1 to 4, more preferably 1 or 2.

In preferable compounds (I), (II) or (III) of the invention, the following preferable substituents or subgroups of the compounds (I), (II) or (III) are generalisable and can be combined in any combination:

When present, the optionally substituted saturated or partially unsaturated hydrocarbyl which optionally contains one or more heteroatoms, as defined above as $R^1$, $R^2$, $R^3$, $R^4$ or $R^5$ substituent of the compounds (I) or (II) or as the hydrocarbyl moiety of the compound (III), is more preferably (i) an optionally substituted linear or branched, saturated or partially unsaturated hydrocarbyl group;

(ii) an optionally substituted linear or branched, saturated or partially unsaturated hydrocarbyl group which bears a saturated or partially unsaturated cyclic hydrocarbyl moiety or an optionally substituted linear or branched, saturated or partially unsaturated hydrocarbyl group which bears an aromatic hydrocarbyl moiety; preferably an optionally substituted linear or branched, saturated or partially unsaturated hydrocarbyl group which bears a saturated or partially unsaturated cyclic hydrocarbyl moiety; or (iii) an optionally substituted saturated or partially unsaturated cyclic hydrocarbyl group.

Preferably, when present, the above ring system (iii) or the saturated or partially unsaturated cyclic hydrocarbyl moiety in the above hydrocarbyl (ii) contains from 5 to 15 ring atoms, and more preferably is saturated or partially unsaturated mono or multicyclic hydrocarbyl ring system which has 5 to 12 ring atoms and which may contain one or more heteroatoms as defined above, more preferably an optionally substituted saturated or partially unsaturated mono or multicyclic hydrocarbyl ring system with 5 to 12 ring atoms, even more preferably a saturated or partially unsaturated monocyclic hydrocarbyl ring with 5 to 7 ring atoms which may contain heteroatoms.

Each of the above options (i), (ii) and (iii) as optionally substituted saturated or partially unsaturated hydrocarbyl group may independently contain one or more hetero atoms as defied above, preferably one or two, which is/are preferably independently selected from O or N, preferably O atom.

If present, then the most preferred linear or branched hydrocarbyl substituent (i) or the most preferred linear or branched hydrocarbyl moiety in hydrocarbyl (ii), as defined above as $R^1$, $R^2$, $R^3$, $R^4$ or $R^5$ substituent of the compounds (I) or (II) or as the hydrocarbyl moiety of the compound (III) are each independently selected from an optionally substituted linear or branched hydrocarbyl group which does not contain any heteroatoms, —Y—NH—Y, Y—$N(Y)_2$, —NH—Y, —$NY_2$, —O—Y, —Y—O—Y or —N(Y—O—$Y)_2$, wherein each Y moiety in the previous groups is an optionally substituted linear or branched hydrocarbyl group which does not contain any heteroatoms. More preferably said optionally substituted linear or branched hydrocarbyl group with no heteroatoms as the hydrocarbyl substituent or as the Y moiety of the compounds (I) or (II) or as the linear or branched hydrocarbyl moiety of the compound (III) is an optionally substituted linear or branched (C1-C50)alkyl group, an optionally substituted linear or branched (C2-C50) alkenyl group or an optionally substituted linear or branched (C2-C30)alkynyl group; more preferably a linear or branched (C1-C50)alkyl group, preferably a linear or branched (C1-C30)alkyl group, more preferably a linear or branched (C1-C20)alkyl group, more preferably a linear or branched (C1-C12)alkyl group, more preferably a linear or branched (C1-C6)alkyl group.

When present, the optionally substituted aromatic hydrocarbyl group as defined above as $R^1$, $R^2$, $R^3$, $R^4$ or $R^5$ substituent or as aromatic hydrocarbyl moiety in the above hydrocarbyl (ii) of the compounds (I) or (II) or as the aromatic hydrocarbyl moiety of the compound (III), is more preferably a mono or multicyclic aryl which has 6 to 12 ring atoms and which may contain one or more heteroatoms as defined above, more preferably a mono or multicyclic aryl with carbon ring atoms, more preferably a phenyl moiety. The aromatic hydrocarbyl group may optionally bear one or more optional substituents and, if present, then preferably bears a functional group as defined below or an optionally substituted linear or branched, saturated or partially unsaturated hydrocarbyl group (i) as defined above or below.

When in compound (I) any two of $R^1$, $R^2$, $R^3$ and $R^4$ together with the atom they are attached to form a substituted or unsubstituted ring system as defined above, then the ring system is preferably saturated, partially unsaturated or aromatic ring system, which is optionally fused with one or more other rings, wherein said ring system and the optional fused ring system optionally contains further heteroatom(s) and may optionally be substituted. Preferably such ring system contains from 5 to 15 ring atoms, more preferably is substituted or unsubstituted, saturated, partially unsaturated or aromatic mono or multicyclic ring system which has 5 to 12 ring atoms, preferably with 5-10 ring atoms, more preferably substituted or unsubstituted, saturated, partially unsaturated or aromatic monocyclic ring system with 5 to 7 ring atoms, which is optionally fused with another substituted or unsubstituted, saturated, partially unsaturated or aromatic ring system, preferably a monocyclic ring, formed by other two of $R^1$, $R^2$, $R^3$ and $R^4$ together with the atom they are attached to and which may contain one or more heteroatoms as defined above.

When in compound (II) any two of $R^1$, $R^2$, $R^3$ $R^4$ and $R^5$ together with the atom they are attached to form a substituted or unsubstituted ring system as defined above, then the ring system is preferably saturated, partially unsaturated or aromatic ring system, which is optionally fused with one or more other rings, wherein said ring system and the optional fused ring system optionally contains further heteroatom(s) and may optionally be substituted. Preferably such ring system contains from 5 to 15 ring atoms, more preferably is substituted or unsubstituted, saturated, partially unsaturated or aromatic mono or multicyclic ring system which has 5 to 12 ring atoms, preferably with 5 to 10 ring atoms, more preferably a preferably substituted or unsubstituted, saturated, partially unsaturated or aromatic monocyclic ring system with 5 to 7 ring atoms, which is optionally fused with another substituted or unsubstituted, saturated, partially unsaturated or aromatic ring system, preferably a monocyclic ring, formed by other two of $R^1$, $R^2$, $R^3$, $R^4$ and $R^5$ together with the atom they are attached to and which may contain one or more heteroatoms as defined above.

Furthermore, when any of the "optionally substituted" linear or branched, saturated or partially unsaturated hydrocarbyl group (i), any of the "optionally substituted" the saturated or partially unsaturated cyclic hydrocarbyl group as a substituent according to hydrocarbyl option (iii) or as a moiety in a hydrocarbyl substituent according to hydrocarbyl option (ii); any of the "optionally substituted" aromatic hydrocarbyl as a substituent or as a moiety in the hydrocarbyl option (ii); any of the "optionally substituted" saturated, partially unsaturated or aromatic ring moiety in compound (III); or any of the "optionally substituted" ring system formed by any two of $R^1$, $R^2$, $R^3$, $R^4$ or, respectively $R^5$, of the compounds (I) or, respectively (II), including the below preferable subgroups thereof, as defined above or below, is substituted, then the "optional substituent(s)" is preferably selected from a "functional group", which is well known expression and means a pendant group, for instance a substituent linked to a phenyl ring. The number of the optional functional group(s) is preferably 1 to 4, preferably 1 to 3, more preferably from 1 or 2. It is preferred that the optional functional group(s) are independently selected from any of the following groups —OH, —$NH_2$, =NH, nitro, thiol, thio$C_{1-12}$alkyl, CN or halogen, such as —F, —Cl, —Br or —I, —COR', —CONR'$_2$, —COOR', wherein each R' is independently H or (C1-C12)alkyl, more preferably from —$NH_2$, —=NH, even more preferably said optional functional group is —$NH_2$.

Moreover, the saturated or partially unsaturated cyclic hydrocarbyl group as a substituent according to hydrocarbyl option (iii) or as a moiety in a hydrocarbyl substituent according to hydrocarbyl option (ii), the aromatic hydrocarbyl as a substituent or as a moiety in the hydrocarbyl option (ii), the saturated, partially unsaturated or aromatic ring moiety in compound (III); or the ring system formed by any two of $R^1$, $R^2$, $R^3$, $R^4$ and, respectively $R^5$ of the compounds (I) or, respectively (II), including the below preferable subgroups thereof, as defined above or below, may, additionally or alternatively to a functional group as the "optional substituent", also bear an optionally substituted linear or branched, saturated or partially unsaturated hydrocarbyl group (i) as defined above or below as said "optional" substituent, which is more preferably a linear or branched (C1-C20)alkyl group, more preferably a linear or branched (C1-C12)alkyl group, more preferably a linear or branched (C1-C6)alkyl group; or any mixtures of said functional and hydrocarbyl groups.

It is noted that the "functional group" as the "optional" substituent is other than any "hetero atom containing hydrocarbyl" substituent of the catalyst compound (b) including the preferred subgroups (I)-(III), other than the above defined "at least one nitrogen containing moiety" of the catalyst compound (b) and, respectively, other than the core moiety depicted in the backbone of compounds (I) or (II), as well as other than the "primary amine" or secondary amine" in compound (III), of the preferred catalyst compound (b).

More preferably, the catalyst (b) is selected from

- a compound (Ia) which is a compound of formula (I), wherein $R^3$ and $R^1$ form together with the atoms they are attached to an partially unsaturated or an aromatic ring which may optionally be fused with a saturated, partially unsaturated or aromatic ring system formed by $R^2$ and $R^4$, wherein said ring or said optionally fused ring system optionally contains one or more further heteroatoms and may optionally be substituted with a one or more groups selected from a hydrocarbyl group or a functional group as defined above;
- a compound (IIa) which is a compound of formula (II), wherein $R^3$ and $R^1$ form together with the atoms they are attached to an partially unsaturated or an aromatic ring which may optionally be fused with a saturated, partially unsaturated or aromatic ring system formed by $R^2$ and $R^4$, wherein said ring or said optionally fused ring system optionally contains one or more further heteroatoms and may optionally be substituted with a one or more groups selected from a hydrocarbyl group or a functional group as defined above; or
- a compound (IIIa) which is a compound (III), wherein the saturated, partially unsaturated or aromatic hydrocarbyl moiety, which comprises two primary amine moieties as defined above, is selected from (i) an optionally substituted linear or branched, saturated or partially unsaturated hydrocarbyl group, (ii) a hydrocarbyl group or (iii) an optionally substituted saturated or partially unsaturated cyclic hydrocarbyl group; or an aromatic hydrocarbyl group; as defined above and may optionally be substituted with one or more further substitutents selected from a hydrocarbyl group or a functional group as defined above.

The catalyst (b) is preferably selected from a compound (Ia), compound (IIa) which additionally contains a further nitrogen atom at least in one of the substituents $R^5$, $R^6$ $R^7$ or $R^8$ or as at least one ring atom; or compound (IIIa).

The catalyst (b) is more preferably selected from subgroups of compounds (Ia), (IIa) and (IIIa), namely from compounds of formula (Ia1), (Ia2) or (IIIa1):

a compound of formula (Ia1)

(Ia1)

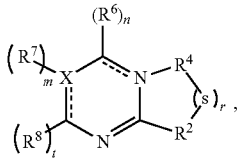

wherein

---- is an optional double bond;

s is a divalent hydrocarbyl group with 1 to 4 atoms;

r is 0 or 1;

the number of n, m and t depends on whether there is a double bond and n=1 or 2;

m=0 or, when X═N, and m=1 or 2, when X═C;

t=1 or 2;

each $R^6$, each $R^7$ and each R is independently H or a hydrocarbyl (i), a hydrocarbyl (ii) or a hydrocarbyl (iii), more preferably as the linear or branched hydrocarbyl (i) or the hydrocarbyl (ii), more preferably as the linear or branched hydrocarbyl (i); as defined above or below, more preferably each $R^6$, each $R^7$ and each $R^8$ is independently selected from H or an optionally substituted linear or branched hydrocarbyl group which contains no heteroatoms, —Y—NH—Y, Y—N(Y)$_2$, —NH—Y, —NY$_2$, —O—Y, —Y—O—Y or —N(Y—O—Y)$_2$, wherein each Y in the previous formulae is independently an optionally substituted linear or branched hydrocarbyl group which contains no heteroatoms; even more preferably said optionally substituted linear or branched hydrocarbyl group which contains no heteroatoms as the hydrocarbyl substituent or as the moiety Y is an optionally substituted linear or branched (C1-C50)alkyl group, an optionally substituted linear or branched (C2-C50)alkenyl group or an optionally substituted linear or branched (C2-C30)alkynyl group; more preferably a linear or branched (C1-C50)alkyl group, preferably a linear or branched (C1-C30)alkyl group, more preferably a linear or branched (C1-C20)alkyl group, more preferably a linear or branched (C1-C12)alkyl group, more preferably a linear or branched (C1-C6)alkyl group; and when r is 1, then the bond between C and N ring atoms is C—N and $R^2$ and $R^4$ form together with s, N and C, wherein they are attached to, a saturated, partially unsaturated or aromatic ring, which is optionally fused with one or more other rings, wherein said ring or the optional fused ring system optionally contains one or more further heteroatoms and may optionally be substituted; preferably form an optionally substituted saturated, partially unsaturated or aromatic mono or multicyclic ring system which has 5 to 15 ring atoms and which may contain further heteroatom(s); more preferably form an optionally substituted, saturated, partially unsaturated or aromatic mono or multicyclic ring system which has 5 to 12 ring atoms, preferably 5 to 10 ring atoms, and which may contain farther heteroatoms; even more preferably form an optionally substituted, saturated, partially unsaturated or aromatic monocyclic hydrocarbyl ring which has 5 to 7 ring atoms and which may contain one or more further heteroatoms; or when r is 0 and if the bond between C and N ring atoms is C═N, then $R^4$ is absent and $R^2$ is H or a hydrocarbyl (i), a hydrocarbyl (ii) or a hydrocarbyl (iii), more preferably a linear or branched hydrocarbyl (i) or a hydrocarbyl (ii), even more preferably a the linear or branched hydrocarbyl (i), as defined above or below; or when r is 0, and if the bond between C and N ring atoms is C—N, then $R^2$ and $R^4$ is independently as defined above for $R^2$;

more preferably each $R^6$, each $R^7$ and each $R^8$ is independently selected from H or an optionally substituted linear or branched hydrocarbyl group which contains no heteroatoms, —Y—NH—Y, Y—N(Y)$_2$, —NH—Y, —NY$_2$, —O—Y, —Y—O—Y or —N(Y—O—Y)$_2$, wherein each Y in the previous formulae is independently an optionally substituted linear or branched hydrocarbyl group which contains no heteroatoms; even more preferably said optionally substituted linear or branched hydrocarbyl group which contains no heteroatoms as the hydrocarbyl substituent or as the moiety Y is an optionally substituted linear or branched (C1-C50)alkyl group, an optionally substituted linear or branched (C2-C50)alkenyl group or an optionally substituted linear or branched (C2-C30)alkynyl group; more preferably a linear or branched (C1-C50)alkyl group, preferably a linear or branched (C1-C30)alkyl group, more preferably a linear or branched (C1-C20)alkyl group, more preferably a linear or branched (C1-C12)alkyl group, more preferably a linear or branched (C1-C6)alkyl group;

a compound of formula (IIa1)

(IIa1)

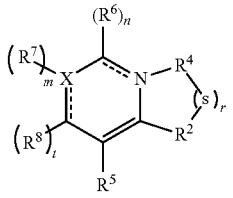

--- is an optional double bond;

s is a divalent hydrocarbyl group with 1 to 4 atoms;

r is 0 or 1;

the number of n, m and t depends on whether there is a double bond and n=1 or 2;

m=0 or 1, when X═N, and m=1 or 2, when X═C;

t=1 or 2;

each $R^6$, each $R^7$, each $R^8$ and $R^5$ is independently H or a hydrocarbyl (i), a hydrocarbyl (ii) or a hydrocarbyl (iii), more preferably as the linear or branched hydrocarbyl (i) or the hydrocarbyl (ii), more preferably as the linear or branched hydrocarbyl (i); as defined above or below, more preferably each $R^6$, each $R^7$, each $R^8$ and $R^5$ is independently selected from H or an optionally substituted linear or branched hydrocarbyl group which contains no heteroatoms, —Y—NH—Y, Y—N(Y)$_2$, —NH—Y, —NY$_2$, —O—Y, —Y—O—Y or —N(Y—O—Y)$_2$, wherein each Y in the previous formulae is independently an optionally substituted linear or branched hydrocarbyl group which contains no heteroatoms; even more preferably said optionally substituted linear or branched hydrocarbyl group which contains no heteroatoms as the hydrocarbyl substituent or as the moiety Y is an optionally substituted linear or branched (C1-C50)alkyl group, an optionally substituted linear or branched (C2-C50)alkenyl group or an optionally substituted linear or branched (C2-C30)alkynyl group; more preferably a linear or branched (C1-C50)alkyl group, preferably a linear or branched (C1-C30)alkyl group, more preferably a linear or branched (C1-C20)alkyl group, more preferably a linear or branched (C1-C12)alkyl group, more preferably a linear or branched (C1-C6)alkyl group; and when r is 1, then the bond between C and N ring atoms is C—N and $R^2$ and $R^4$ form together with s, N and C, wherein they are attached to, a saturated, partially unsaturated or aromatic ring, which is optionally fused with one or more other rings, wherein said ring or the optional fused ring system optionally contains one or more further heteroatoms and may optionally be substituted; preferably form an optionally substituted saturated, partially unsaturated or aromatic mono or multicyclic ring system which has 5 to 15 ring atoms and which may contain further heteroatom(s); more preferably form an optionally substituted, saturated, partially unsaturated or aromatic mono or multicyclic ring system which has 5 to 12 ring atoms, preferably 5 to 10 ring atoms, and which may contain further heteroatoms; even more preferably form an optionally substituted, saturated, partially unsaturated or aromatic monocyclic hydrocarbyl ring which has 5 to 7 ring atoms and which may contain one or more further heteroatoms; or when r is 0 and if the bond between C and N ring atoms is C═N, then $R^4$ is absent and $R^2$ is H or a hydrocarbyl (i), a hydrocarbyl (ii) or a hydrocarbyl (iii), more preferably a linear or branched hydrocarbyl (i) or a hydrocarbyl (ii), even more preferably a the linear or branched hydrocarbyl (i), as defined above or below; or when r is 0, and if the bond between C and N ring atoms is C—N, then $R^2$ and $R^4$ is independently as defined above for $R^2$;

more preferably each $R^6$, each $R^7$, each $R^8$ and $R^5$ is independently selected from H or an optionally substituted linear or branched hydrocarbyl group which contains no heteroatoms, —Y—NH—Y, Y—N(Y)$_2$, —NH—Y, —NY$_2$, —O—Y, —Y—O—Y or —N(Y—O—Y)$_2$, wherein each Y in the previous formulae is independently an optionally substituted linear or branched hydrocarbyl group which contains no heteroatoms; even more preferably said optionally substituted linear or branched hydrocarbyl group which contains no heteroatoms as the hydrocarbyl substituent or as the moiety Y is an optionally substituted linear or branched (C1-C50)alkyl group, an optionally substituted linear or branched (C2-C50)alkenyl group or an optionally substituted linear or branched (C2-C30)alkynyl group; more preferably a linear or branched (C1-C50)alkyl group, preferably a linear or branched (C1-C30)alkyl group, more preferably a linear or branched (C1-C20)alkyl group, more preferably a linear or branched (C1-C12)alkyl group, more preferably a linear or branched (C1-C6)alkyl group; or a compound of formula (IIIa1)

$$(R^{13})_2N—R^{12}—N(R^{14})_2 \quad \text{(IIIa1)},$$

wherein each $R^{13}$ and each $R^{14}$ is independently H or a hydrocarbyl (i), a hydrocarbyl (ii) or a hydrocarbyl (iii), more preferably a linear or branched hydrocarbyl (i) or a hydrocarbyl (ii), more preferably a linear or branched hydrocarbyl (i), as defined above or below, more preferably each $R^{13}$ and each $R^{14}$ is independently selected from H or an optionally substituted linear or branched hydrocarbyl group which contains no heteroatoms, —Y—NH—Y, Y—N(Y)$_2$, —NH—Y, —NY$_2$, —O—Y, —Y—O—Y or —N(Y—O—Y)$_2$, wherein each Y in the previous formulae is independently an optionally substituted linear or branched hydrocarbyl group which contains no heteroatoms; even more preferably said optionally substituted linear or branched hydrocarbyl group which contains no heteroatoms as the hydrocarbyl substituent or as the moiety Y is an optionally substituted linear or branched (C1-C50)alkyl group, an optionally substituted linear or branched (C2-C50)alkenyl group or an optionally substituted linear or branched (C2-C30)alkynyl group; more preferably a linear or branched (C1-C50)alkyl group, preferably a linear or branched (C1-C30)alkyl group, more preferably a linear or branched (C1-C20)alkyl group, more preferably a linear or branched (C1-C12)alkyl group, more preferably a linear or branched (C1-C6)alkyl group; and $R^{12}$ is a hydrocarbyl (i), a hydrocarbyl (ii) or a hydrocarbyl (iii), more preferably a linear or branched hydrocarbyl (i) or a hydrocarbyl (ii), even more preferably a linear or branched hydrocarbyl (i), as defined above, more preferably $R^{12}$ is independently selected from H or an optionally substituted linear or branched hydrocarbyl group which contains no heteroatoms, —Y—NH—Y, Y—N(Y)$_2$, —NH—Y, —NY$_2$, —O—Y, —Y—O—Y, —Y—O—Y—O—Y— or —N(Y—O—Y)$_2$, wherein each Y in the previous formulae is independently an optionally substituted linear or branched hydrocarbyl group which contains no heteroatoms; even more preferably said optionally substituted linear or branched hydrocarbyl group which contains no heteroatoms as the hydrocarbyl substituent or as the moiety Y is an optionally substituted linear or branched (C1-C50)alkyl group, an optionally substituted linear or branched (C2-C50)alkenyl group or an optionally substituted linear or branched (C2-C30)alkynyl group; more preferably a linear or branched (C1-C50)alkyl group, preferably a linear or branched (C1-C30)alkyl group, more preferably a linear or branched (C1-C20)alkyl group, more preferably a linear or branched (C1-C12)alkyl group, more preferably a linear or branched (C1-C6)alkyl group.

The catalyst (b) is more preferably compound (Ia1), wherein r is 1 or; r is 0, wherein $R^2$ and $R^4$ is each independently H or a hydrocarbyl group as defined above; and X is N-atom.

Even more preferably the catalyst (b) is selected from subgroups of compounds (Ia1), (IIa2) and (IIIa1), namely from compounds of formula (Ia2), (Ia3) or (IIIa2):

a compound of formula (Ia2)

(Ia2)

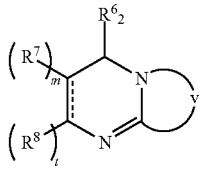

wherein

--- is an optional double bond v is a divalent hydrocarbyl group with 3 to 6 ring atoms;

r is 0 or 1; the number of m and t depends on whether there is a double bond and m=1 or 2;

t=1 or 2;

each $R^6$, each $R^7$ and each R is independently H or a hydrocarbyl group as defined above as the hydrocarbyl (i), the hydrocarbyl (ii) or the hydrocarbyl (iii), more preferably as the linear or branched hydrocarbyl (i) or the hydrocarbyl (ii), more preferably as the linear or branched hydrocarbyl (i), as defined above, more preferably each $R^6$, each $R^7$ and each $R^8$ is independently selected from H or an optionally substituted linear or branched hydrocarbyl group which contains no heteroatoms, —Y—NH—Y, Y—N(Y)$_2$, —NH—Y, —NY$_2$, —O—Y, —Y—O—Y or —N(Y—O—Y)$_2$, wherein each Y in the previous formulae is independently an optionally substituted linear or branched hydrocarbyl group which contains no heteroatoms; even more preferably said optionally substituted linear or branched hydrocarbyl group which contains no heteroatoms as the hydrocarbyl substituent or as the moiety Y is an optionally substituted linear or branched (C1-C50)alkyl group, an optionally substituted linear or branched (C2-C50)alkenyl group or an optionally substituted linear or branched (C2-C30)alkynyl group; more preferably an optionally substituted linear or branched (C1-C50)alkyl group, more preferably an optionally substituted linear or branched (C1-C30) alkyl group, more preferably an unsubstituted linear or branched (C1-C20)alkyl group, more preferably an unsubstituted linear or branched (C1-C12)alkyl group, more preferably an unsubstituted linear or branched (C1-C6)alkyl group; and v forms together with N and C, wherein it is attached to, a saturated, partially unsaturated or aromatic ring, which is optionally fused with one or more other rings, wherein said ring or the optional fused ring system optionally contains one or more further heteroatoms and may optionally be substituted, preferably forms a saturated, partially unsaturated or aromatic mono or multicyclic ring system which has 5 to 15 ring atoms and which may contain further heteroatom(s), more preferably forms an optionally substituted, saturated, partially unsaturated or aromatic mono or multicyclic ring system which has 5 to 12 ring atoms, preferably 5 to 10 ring atoms, and which may contain further heteroatoms, even more preferably forms an optionally substituted, saturated, partially unsaturated or aromatic monocyclic hydrocarbyl ring which has 5 to 7 ring atoms and which is preferably unsubstituted and, preferably, contains no further heteroatoms;

a compound of formula (Ia3)

(Ia3)

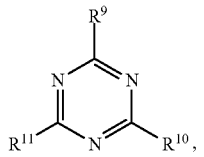

wherein each $R^9$, $R^{10}$ and $R^{11}$ independently is H; a functional group or a hydrocarbyl group as defined above as the hydrocarbyl (i), the hydrocarbyl (ii) or the hydrocarbyl (iii), more preferably as the linear or branched hydrocarbyl (i) or the hydrocarbyl (ii), more preferably as the linear or branched hydrocarbyl (i), as defined above; more preferably each $R^9$, $R^{10}$ and $R^{11}$ is independently selected from H; functional group which is —NH$_2$ or an optionally substituted linear or branched hydrocarbyl group which contains no heteroatoms, —Y—NH—Y, Y—N(Y)$_2$, —NH—Y, —NY$_2$, —O—Y, —Y—O—Y or —N(Y—O—Y)$_2$, wherein each Y in the previous formulae is independently an optionally substituted linear or branched hydrocarbyl group which contains no heteroatoms; even more preferably said optionally substituted linear or branched hydrocarbyl group with no heteroatoms as the hydrocarbyl substituent or as the moiety Y is an optionally substituted linear or branched (C1-C50)alkyl group, an optionally substituted linear or branched (C2-C50)alkenyl group or an optionally substituted linear or branched (C2-C30)alkynyl group; more preferably an optionally substituted linear or branched (C1-C50) alkyl group, more preferably an optionally substituted linear or branched (C1-C30)alkyl group, more preferably an unsubstituted linear or branched (C1-C20)alkyl group, more preferably an unsubstituted linear or branched (C1-C12) alkyl group, more preferably an unsubstituted linear or branched (C1-C6)alkyl group; more preferably each $R^9$, $R^{10}$ and $R^{11}$ is independently selected from —NH$_2$, —NY$_2$ or —N(Y—O—Y)$_2$, wherein each Y as defined above; even more preferably form —NH$_2$ or —N(Y—O—Y)$_2$, wherein each Y as defined above; or a compound of formula (IIIa2)

$$(R^{13})_2N—(CH_2)_w—O—(CH_2)_p—O—(CH_2)_k—N(R^{14})^2 \quad \text{(IIa2)},$$

wherein w+p+k=3 to 20, preferably 5-10, more preferably x=1-3; p=1-3 and k=1-3; and each $R^{13}$ and each $R^{14}$ is independently H or an unsubstituted linear or branched (C1-C30)alkyl group, more preferably an unsubstituted linear or branched (C1-C20)alkyl group, more preferably an unsubstituted linear or branched (C1-C12)alkyl group, more preferably an unsubstituted linear or branched (C1-C6)alkyl group; more preferably each $R^{13}$ and each $R^{14}$ is H.

The most preferred catalyst (b) is a subgroup of the compound (Ia2), namely a compound of formula (Ia4):

(Ia4)

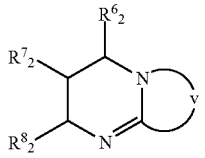

each $R^6$, each $R^7$ and each $R^8$ is independently 11 or a hydrocarbyl group as defined above as the hydrocarbyl (i), the hydrocarbyl (ii) or the hydrocarbyl (iii), more preferably as the linear or branched hydrocarbyl (i) or the hydrocarbyl (ii), more preferably as the linear or branched hydrocarbyl (i), as defined above, more preferably each $R^6$, each $R^7$ and each $R^8$ is independently selected from H or an optionally substituted linear or branched hydrocarbyl group which contains no heteroatoms, —Y—NH—Y, Y—N(Y)$_2$, —NH—Y, —NY$_2$, —O—Y, —Y—Y or —N(Y—O—Y)$_2$, wherein each Y in the previous formulae is independently an optionally substituted linear or branched hydrocarbyl group which contains no heteroatom s; even more preferably said optionally substituted linear or branched hydrocarbyl group with no heteroatoms as the hydrocarbyl substituent or as the moiety Y is an optionally substituted linear or branched (C1-C50)alkyl group, an optionally substituted linear or branched (C2-C50)alkenyl group or an optionally substituted linear or branched (C2-C30)alkynyl group; more preferably an optionally substituted linear or branched (C1-C50) alkyl group, more preferably an optionally substituted linear or branched (C1-C30)alkyl group, more preferably an unsubstituted linear or branched (C1-C20)alkyl group, more preferably an unsubstituted linear or branched (C1-C12) alkyl group, more preferably an unsubstituted linear or branched (C1-C6)alkyl group; and v forms together with N and C ring atoms, wherein it is attached to, a saturated, partially unsaturated or aromatic ring system, which is optionally fused with one or more other rings, wherein said ring system or the optional fused ring system optionally contains one or more further heteroatoms and may optionally be substituted, preferably a saturated, partially unsaturated or aromatic mono or multicyclic ring system which has 5 to 15 ring atoms and which may contain further heteroatom(s), more preferably is an optionally substituted, saturated, partially unsaturated or aromatic mono or multicyclic ring system which has 5 to 12 ring atoms, preferably 5 to 10 ring atoms, and which may contain further heteroatoms, more preferably an optionally substituted, saturated, partially unsaturated or aromatic monocyclic hydrocarbyl ring which has 5 to 7 ring atoms and which is preferably unsubstituted and, preferably, contains no further heteroatoms.

It is preferred in the above formulae (Ia1), (IIa1), (IIa1), (Ia2), (Ia3), (IIIa2) and (Ia4) that the hydrocarbyl group, which contains no heteroatoms, or the moiety Y, contains no optional substituents, i.e. is unsubstituted.

Preferred non-limiting examples of the preferable compounds (Ia4) of compounds (I) as catalyst (b) are

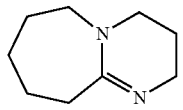

which is 1,8-Diazabicyclo [5.4.0] undec-7-ene (DBU), Mw of 152 g/mol, CAS-nr. 6674-22-2, Supplier Sigma-Aldrich; and

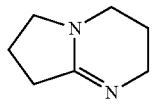

which is 1,5-Diazabicyclo [4.3.0] no-5-ene (DBN), Mw of 124 g/mol, CAS-nr. 3001-72-7, Suplier Sigma-Aldrich.

Preferable non-limiting example of the preferable compounds (Ia3) of compounds (I) as catalyst (b) is

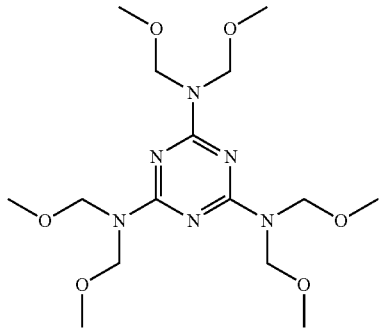

which is hexamethoxymethyl melamine, MW of 390 g/mol, CAS-nr. 68002-20-0, commercially available from Cytec with commercial name Cyrez 963.

A non-limiting example of the preferable compounds (IIIa2) of compounds (III) as catalyst (b) is $H_2N—(CH_2)_2—O—(CH_2)_2—O—(CH^2)_2—NH_2$, MW of 148 g/mol, CAS-nr. 929-59-9, commercially available from Huntsman, with commercial name Jeffamine®EDR-148.

The most preferred catalyst (b) of the invention is the compound of formula (I), as defined above or in claims, more preferred is the subgroup of compounds (I) which is compounds (Ia2), as defined above or in claims, most preferred is the subgroup of compounds (I) which is compounds (Ia4), as defined above or in claims.

Suitable compounds (I), (II) and (III) as the silanol catalyst compound (b) including their preferred subgroups are as such well known and can be e.g. commercially available or can be prepared according to or analogously to known preparation methods described in the chemical literature.

Polyolefin Bearing Hydrolysable Silane Groups (a) (=Polyolefin (a))

Where herein it is referred to a "polymer", e.g. polyolefin, such as polyethylene, this is intended to mean both a homo- or copolymer, e.g. a homopolymer and copolymer of an olefin, such as a homopolymer and copolymer ethylene.

The hydrolysable silane groups may be introduced into the polyolefin of polyolefin (a) by copolymerisation of olefin, e.g. ethylene, monomer with at least silane group(s) containing comonomer(s) or by grafting a silane group(s) containing compound(s) to the polyolefin. Grafting is preferably effected by radical reaction, e.g. in the presence of a radical forming agent (such as peroxide). Both techniques are well known in the art.

Preferably, the polyolefin bearing hydrolysable silane groups (a) is a copolymer of olefin with a silane group(s) bearing comonomer and, optionally, with other comonomer(s); or is a homopolymer or copolymer of olefin with silane groups which are introduced by grafting a silane group(s) containing compound to the polyolefin polymer.

As well known "comonomer" refers to copolymerisable comonomer units.

The silane group(s) containing comonomer for copolymerising silane groups or the silane group(s) containing compound for grafting silane groups to produce polyolefin (a) is preferably an unsaturated silane compound/comonomer represented by the formula $$R^1SiR^2_qY_{3-q} \quad \text{(IV)}$$

wherein $R^1$ is an ethylenically unsaturated hydrocarbyl, hydrocarbyloxy or (meth)acryloxy hydrocarbyl group.

$R^2$ is an aliphatic saturated hydrocarbyl group,

Y which may be the same or different, is a hydrolysable organic group and q is 0, 1 or 2.

The hydrocarbyl moiety present in any substituent as $R^1$ of compound/comonomer (IV) can be linear or branched hydrocarbyl or a cyclic hydrocarbyl.

More preferable subgroup of compounds/comonomers (IV) are compounds/comonomers of (Icc), wherein $R^1$ is vinyl, allyl, isopropenyl, butenyl, cyclohexanyl or gamma-(meth)acryloxy alkyl; and Y is methoxy, ethoxy, formyloxy, acetoxy, propionyloxy or an alkyl- or arylamino group; and $R^2$, if present, is a methyl, ethyl, propyl, decyl or phenyl group, preferably $R^2$ is not present.

Even more preferable subgroup of silane compounds/comonomers (IV) are compounds/comonomers selected from compounds/comonomers of formula (IVa) or compounds/comonomers of formula (IVb):

$$CH_2{=}CH—(CH_2)_t—Si(OA)_3 \quad \text{(IVa)},$$

wherein t=0 to 6, preferably 0 to 5, preferably 0 to 4, more preferably 0 to 3, preferably 0 to 2, more preferably 0 or 1, most preferably 0; and A is a hydrocarbyl group, formyl group or acetyl group, preferably a hydrocarbyl group having 1-8 carbon atoms, preferably 1-4 carbon atoms; or $$CH_2{=}C(X){-}C({=}O){-}O{-}(CH_2){-}Si(OA)_3 \quad \text{(IVb)},$$

wherein s=1 to 6, preferably 1 to 5, more preferably 1 to 4, more preferably 1, 2 or 3, most preferably 3;

X is H or $-CH_3$, preferably $-CH_3$; and

A is a hydrocarbyl group, formyl group or acetyl group, preferably a hydrocarbyl group having 1 to 8 carbon atoms, preferably 1 to 4 carbon atoms.

As evident for a skilled person, the choice of the suitable unsaturated silane compound/comonomer depends i.a. on the desired crosslinking effect, e.g. desired crosslinking speed, which can be adjusted e.g. with the desired accessibility of the silane groups to the crosslinking catalyst. The accessibility in turn can be adjusted, as well known, e.g. by the length of the silane side chain protruding from the polymer backbone.

The most preferred unsaturated silane compounds/comonomers for the present invention are compounds (IVa) and (IVb), preferably vinyl trimethoxysilane, vinyl bismethoxyethoxysilane, vinyl triethoxysilane or gamma-(meth)acryloxypropyl trimethoxysilane.

The silane compounds/comonomers for the present invention are well known and available as a commercial product or can be produced according to or analogously to processes documented in the chemical literature.

A suitable polyolefin for the polyolefin (a) bearing hydrolysable silane group(s) containing units can be any polyolefin, such as any conventional polyolefin, which can be used for producing a cable layer of a cable of the present invention. For instance such suitable conventional polyolefins are as such well known and can be e.g. commercially available or can be prepared according to or analogously to known polymerization processes described in the chemical literature.

The polyolefin (a) for the polymer composition is preferably selected from a polypropylene (PP) or polyethylene (PE), preferably from a polyethylene, bearing hydrolysable silane group(s) containing units.

In case a polyolefin (a) is a copolymer of ethylene with at least one comonomer other than silane group(s) containing comonomer (referred herein also shortly as "other comonomer") and wherein the silane group(s) containing units are incorporated by grafting or copolymerizing with a silane group(s) containing compound/comonomer, then suitable such other comonomer is selected from non-polar comonomer(s) or polar comonomer(s), or any mixtures thereof. Preferable other non-polar comonomers and polar comonomers are described below in relation to polyethylene produced in a high pressure process.

Preferable polyolefin (a) is a polyethylene produced in the presence of an olefin polymerisation catalyst or a polyethylene produced in a high pressure process and which bears hydrolysable silane group(s) containing units.

"Olefin polymerisation catalyst" means herein preferably a coordination catalyst. Such coordination catalyst has a well known meaning and is preferably selected from a Ziegler-Natta catalyst, single site catalyst which term comprises a metallocene and a non-metallocene catalyst, or a chromium catalyst, or a Vanadium catalyst or any mixture thereof. The terms have a well known meaning.

Polyethylene polymerised in the presence of an olefin polymerisation catalyst in a low pressure process is also often called as "low pressure polyethylene" to distinguish it clearly from polyethylene produced in a high pressure process. Both expressions are well known in the polyolefin field. Low pressure polyethylene can be produced in polymerisation process operating i.a. in bulk, slurry, solution, or gas phase conditions or in any combinations thereof. The olefin polymerisation catalyst is typically a coordination catalyst.

More preferably, the polyolefin (a) is selected from a homopolymer or a copolymer of ethylene produced in the presence of a coordination catalyst or produced in a high pressure polymerisation process, which bears hydrolysable silane group(s) containing units.

In a first embodiment of the polyolefin (a) of the polymer composition of the invention, the polyolefin (a) is a low pressure polyethylene (PE) bearing the hydrolysable silane group(s) containing units. Such low pressure PE is preferably selected from a very low density ethylene copolymer (VLDPE), a linear low density ethylene copolymer (LLDPE), a medium density ethylene copolymer (MDPE) or a high density ethylene homopolymer or copolymer (HDPE), which bears hydrolysable silane group(s) containing units. These well known types are named according to their density area. The term VLDPE includes herein polyethylenes which are also known as plastomers and elastomers and covers the density range of from 850 to 909 kg/m$^3$. The LLDPE has a density of from more than 909 to 930 kg/m$^3$, preferably of from more than 909 to 929 kg/m, more preferably of from 915 to 929 kg/m$^3$. The MDPE has a density of from more than 929 to 945 kg/m$^3$, preferably 930 to 945 kg/m$^3$. The HDPE has a density of more than 945 kg/m$^3$, preferably of more than 946 kg/m$^3$, preferably form 946 to 977 kg/m$^3$, more preferably form 946 to 965 kg/m$^3$. More preferably such low pressure copolymer of ethylene for the polyolefin (a) is copolymerized with at least one comonomer selected from C3-20 alpha olefin, more preferably from C4-12 alpha-olefin, more preferably from C4-8 alpha-olefin, e.g. with 1-butene, 1-hexene or 1-octene, or a mixture thereof. The amount of comonomer(s) present in a PE copolymer is from 0.1 to 15 mol %, typically 0.25 to 10 mol-%.

Moreover, in case the polyolefin (a) is a low pressure PE polymer bearing the hydrolysable silane group(s) containing units, then such PE can be unimodal or multimodal with respect to molecular weight distribution (MWD=Mw/Mn). Generally, a polymer comprising at least two polymer fractions, which have been produced under different polymerization conditions resulting in different (weight average) molecular weights and molecular weight distributions for the fractions, is referred to as "multimodal". The prefix "multi" relates to the number of different polymer fractions present in the polymer. Thus, for example, multimodal polymer includes so called "bimodal" polymer consisting of two fractions.

"Polymer conditions" mean herein any of process parameters, feeds and catalyst system.

Unimodal low pressure PE can be produced by a single stage polymerisation in a single reactor in a well known and documented manner. The multimodal PE can be produced in one polymerisation reactor by altering the polymerisation conditions and optionally the catalyst, or, and preferably, in the multistage polymerisation process which is conducted in at least two cascaded polymerisation zones. Polymerisation zones may be connected in parallel, or preferably the polymerisation zones operate in cascaded mode. In the preferred multistage process a first polymerisation step is carried out in at least one slurry, e.g. loop, reactor and the second polymerisation step in one or more gas phase reactors. One preferable multistage process is described in EP517868. Preferably, the same catalyst is used in each polymerisation stage of a multistage process.

A LLDPE, MDPE or HDPE as defined above or below are preferable type of low pressure PE for polyolefin (a), more preferably a LLDPE copolymer as defined above or below. Such LLDPE can unimodal or multimodal.

The silane group(s) containing units can be incorporated to the low pressure polyethylene by grafting or by copolymerizing ethylene with a silane group(s) containing comonomer and optionally with other comonomer(s), which is preferably a non-polar comonomer. Preferable hydrolysable silane groups bearing low pressure PE as the polyolefin (a) is a HDPE homopolymer or copolymer, MDPE copolymer or a LLDPE copolymer, wherein the silane group(s) are incorporated by grafting a silane group(s) containing compound.

The low pressure PE as the polyolefin bearing hydrolysable silane groups (a) has preferably an $MFR_2$ of up to 1200 g/10 min, such as of up to 1000 g/10 min, preferably of up to 500 g/10 min, preferably of up to 400 g/10 min, preferably of up to 300 g/10 min, preferably of up to 200 g/10 min, preferably of up to 150 g/10 min, preferably from 0.01 to 100, preferably from 0.01 to 50 g/10 min, preferably from 0.01 to 40.0 g/10 min, preferably of from 0.05 to 30.0 g/10 min, preferably of from 0.1 to 20.0 g/10 min, more preferably of from 0.2 to 15.0 g/10 min.

In a second embodiment of the polyolefin (a) of the invention, the polyolefin (a) is a polyethylene which is produced in a high pressure polymerisation (HP) process and bears hydrolysable silane group(s) containing units. In this embodiment the polyethylene is preferably produced in a high pressure polymerisation process in the presence of an initiator(s), more preferably is a low density polyethylene (LDPE) bearing hydrolysable silane group(s) containing units. It is to be noted that a polyethylene produced in a high pressure (HP) process is referred herein generally as LDPE and which term has a well known meaning in the polymer field. Although the term LDPE is an abbreviation for low density polyethylene, the term is understood not to limit the density range, but covers the LDPE-like HP polyethylenes with low, medium and higher densities. The term LDPE describes and distinguishes only the nature of HP polyethylene with typical features, such as different branching architecture, compared to the PE produced in the presence of an olefin polymerisation catalyst.

The polyolefin (a) according to the second embodiment is the preferred polyolefin (a) of the invention and is a polyethylene which is produced by a high pressure polymerisation (HP) and which bears hydrolysable silane group(s) containing units.

In this preferable second embodiment, such hydrolysable silane groups bearing LDPE polymer as polyolefin (a) may be a low density homopolymer of ethylene (referred herein as LDPE homopolymer) or a low density copolymer of ethylene (referred herein as LDPE copolymer) with at least one comonomer selected from the silane group(s) containing comonomer, which is preferably as defined above, or from the other comonomer as mentioned above, or any mixtures thereof. The one or more other comonomer(s) of LDPE copolymer are preferably selected from polar comonomer(s), non-polar comonomer(s) or from a mixture of polar comonomer(s) and non-polar comonomer(s), as defined above or below. Moreover, said LDPE homopolymer or LDPE copolymer as said polyolefin (a) may optionally be unsaturated.

As a polar comonomer, if present in the hydrolysable silane group(s) bearing LDPE copolymer as the polyolefin (a), such polar comonomer is preferably selected from a comonomer containing hydroxyl group(s), alkoxy group(s), carbonyl group(s), carboxyl group(s), ether group(s) or ester group(s), or a mixture thereof. Moreover, comonomer(s) containing carboxyl and/or ester group(s) are more preferable as said polar comonomer. Still more preferably, the polar comonomer(s), if present in the hydrolysable silane groups bearing LDPE copolymer as the polyolefin (a), is selected from the groups of acrylate(s), methacrylate(s) or acetate(s), or any mixtures thereof, more preferably the polar comonomer(s) is selected from the group of alkyl acrylates, alkyl methacrylates or vinyl acetate, or a mixture thereof, even more preferably from $C_1$- to $C_6$-alkyl acrylates, $C_1$- to $C_6$-alkyl methacrylates or vinyl acetate. Still more preferably, if polar comonomer(s) are present, then the hydrolysable silane groups bearing LDPE copolymer as the polyolefin (a) is a copolymer of ethylene with $C_1$- to $C_4$-alkyl acrylate, such as methyl, ethyl, propyl or butyl acrylate, or vinyl acetate, or any mixture thereof, which bears hydrolysable silane group(s) containing units.

As the non-polar comonomer, if present in the hydrolysable silane group(s) bearing LDPE copolymer as the polyolefin (a), such non-polar comonomer is other than the above defined polar comonomer. Preferably, the non-polar comonomer is other than a comonomer containing hydroxyl group(s), alkoxy group(s), carbonyl group(s), carboxyl group(s), ether group(s) or ester group(s). One group of preferable non-polar comonomers, if present in the hydrolysable silane group(s) bearing LDPE copolymer as the polyolefin (a), comprises, preferably consists of, monounsaturated (=one double bond) comonomer(s), preferably olefins, preferably alpha-olefins, more preferably $C_3$ to $C_{10}$ alpha-olefins, such as propylene, 1-butene, 1-hexene, 4-methyl-1-pentene, styrene, 1-octene, 1-nonene; polyunsaturated (=more than one double bond, such as diene) comonomer(s); or any mixtures thereof.

If the hydrolysable silane group(s) bearing LDPE polymer as the polyolefin (a) is a copolymer of ethylene with other comonomer(s), then the amount of the other comonomer(s) present in said LDPE polymer is preferably from 0.001 to 50 wt %, more preferably from 0.05 to 40 wt %, still more preferably less than 35 wt %, still more preferably less than 30 wt %, more preferably less than 25 wt %. If present, then the polar comonomer content of the polyolefin (a) is preferably at least 0.05 mol %, preferably 0.1 mol % or more, more preferably 0.2 mol % or more, and at least in insulation layer applications the polar comonomer content of the polyolefin (a) is preferably not more than 10 mol %, preferably not more than 6 mol %, preferably not more than 5 mol %, more preferably not more than 2.5 mol %, based on the polyolefin (a).

As already mentioned, the silane group(s) can be incorporated to the high pressure polyethylene, preferably to the LDPE polymer, as the preferred polyolefin (a) by grafting or by copolymerizing ethylene with a silane group(s) containing comonomer and optionally with other comonomer(s), more preferably by copolymerizing ethylene with a silane group(s) containing comonomer. In this preferred second embodiment the polyolefin (a) is most preferably a LDPE copolymer of ethylene with a silane group containing comonomer as defined above or below and optionally with other comonomer(s).

Typically, and preferably in wire and cable (W&C) applications, the density of the LDPE polymer bearing hydrolysable silane groups as the polyolefin (a), is higher than 860 $kg/m^3$. Preferably the density of such LDPE polymer, is not higher than 960 kg/m, and preferably is from 900 to 945 kg/m$^3$. The $MFR_2$ (2.16 kg, 190° C.) of the LDPE polymer bearing hydrolysable silane groups as the polyolefin (a), is preferably from 0.01 to 50 g/10 min, more preferably from 0.01 to 40.0 g/10, more preferably is from 0.1 to 20 g/10 min, and most preferably is from 0.2 to 10 g/10 min.

Accordingly, the LDPE polymer for the polyolefin (a) is preferably produced at high pressure by free radical initiated polymerisation (referred to as high pressure (HP) radical polymerization). The HP reactor can be e.g. a well known tubular or autoclave reactor or a mixture thereof, preferably a tubular reactor. The high pressure (HP) polymerisation and the adjustment of process conditions for further tailoring the other properties of the polyolefin depending on the desired end application are well known and described in the literature, and can readily be used by a skilled person. Suitable polymerisation temperatures range up to 400° C., preferably from 80 to 350° C. and pressure from 70 MPa, preferably 100 to 400 MPa, more preferably from 100 to 350 MPa. Pressure can be measured at least after compression stage and/or after the tubular reactor. Temperature can be measured at several points during all steps.

The incorporation of hydrolysable silane group(s) containing comonomer (as well as optional other comonomer(s)) and the control of the comonomer feed to obtain the desired final content of said hydrolysable silane group(s) containing units can be carried out in a well known manner and is within the skills of a skilled person. Similarly, the MFR of the polymerized polymer can be controlled e.g. by a chain transfer agent, as well known in the field.

Further details of the production of ethylene (co)polymers by high pressure radical polymerization can be found i.a. in the Encyclopedia of Polymer Science and Engineering, Vol. 6 (1986), pp 383-410 and Encyclopedia of Materials: Science and Technology, 2001 Elsevier Science Ltd.: "Polyethylene: High-pressure, R. Klimesch, D. Littmann and F.-O. Mähling pp. 7181-7184.

The polyolefin bearing hydrolysable silane groups (a) is most preferably selected from a homopolymer or copolymer of ethylene produced in a low pressure polymerisation process in the presence of a coordination catalyst, as defined above, and grafted with a silane group bearing compound, as defined above, or from a copolymer of ethylene produced in a high pressure polymerisation process, as defined above or below, by copolymerising ethylene with at least one silane group(s) bearing comonomer, as defined above or below, and, optionally, with one or more other comonomer(s). More preferably, the polyolefin bearing hydrolysable silane groups (a) has been obtained by copolymerisation of ethylene in a high pressure process with at least silane group bearing comonomer as defined above, and, optionally, with one or more other comonomer(s).

The Polymer Composition (=Polymer Composition of the Invention)

The polymer composition preferably comprises the silanol condensation catalyst (b) in an amount of 0.0001 wt % or more, preferably up to 6.0 wt %, preferably 0.01 to 2.0 wt %, more preferably 0.02 to 0.5 wt %, based on the combined amount of the polyolefin (a) and silanol condensation catalyst (b).

The polymer composition preferably comprises the polyolefin (a) in an amount of 99.9999 wt % or less, preferably at least 94.0 wt % or more, preferably of 99.99 to 98.0 wt %, more preferably of 99.98 to 99.5 wt %, based on the combined weight of the polyolefin (a) and the silanol condensation catalyst (b).

Preferably, the polymer composition comprises hydrolysable silane group(s) in an amount of from 0.001 to 12 mol %, preferably of from 0.01 to 4 mol %, most preferably of from 0.05 to 1.6 mol %, based on the total amount (weight) of the polymer composition. More preferably the mol % amount (calculated from the wt % as determined below under "Determination methods") of the hydrolysable silane group(s) is based on the total amount of the polyolefin (a) component.

"Silane group" means herein the hydrolysable silane moiety. Preferable silane-moiety is $(Y)_{3-q}Si$— moiety as defined above in formula (IV) which is crosslinkable by hydrolysation and subsequent condensation reaction in the presence of a silanol condensation catalyst and water, as known in the art, to form Si—O—Si links between other hydrolysable silane-groups present in said polyolefin (a) component. Preferred hydrolysable silane-group is a hydrolysable $(AO)_3Si$-moiety as defined above in formula (IVa) or (IVb).

The polymer composition may contain further components, such as further polymer component(s), like miscible thermoplastic(s), additive(s), such as antioxidant(s), further stabilizer(s), e.g. water treeing retardant(s), scorch retardant(s); lubricant(s), foaming agent(s), filler(s), such as carbon black; or colorant(s).

The total amount of further polymer component(s), if present, is typically up to 60 wt %, preferably up 50 wt %, preferably up 40 wt %, more preferably from 0.5 to 30 wt %, preferably from 0.5 to 25 wt %, more preferably from 1.0 to 20 wt %, based on the total amount of the polymer composition.

The total amount of additive(s), if present, is generally from 0.01 to 10 wt %, preferably from 0.05 to 7 wt %, more preferably from 0.2 to 5 wt %, based on the total amount of the polymer composition.

The polymer composition may, and preferably, comprises antioxidant(s), preferably antioxidant(s) which is preferably neutral or basic. Preferably, the antioxidant is present in the composition in an amount of from 0.01 to 3 wt %, more preferably 0.05 to 2 wt %, and most preferably 0.08 to 1.5 wt %, based on the total amount of the polymer composition.

Preferably the polymer composition comprises no separate carboxylic acid compound for use as an additional crosslinking agent or crosslinking booster.

The polymer composition may comprise a filler(s), e.g. a conductive filler, such as a conductive carbon black, if used as semiconductive compositions; or a flame retardant filler(s), such as magnesium or aluminium hydroxide, if used as flame retardant composition; or a UV protecting filler(s), such as UV-carbon black or UV stabiliser, if used as UV-stabilised composition; or any combination(s) thereof. The amount of the filler in general depends on the nature of the filler and the desired end application, as evident for a skilled person. E.g. when the polymer composition comprises conductive filler, then the amount thereof is of up to 65 wt %, preferably from 5 to 50 wt %, based on the total amount of the polymer composition.

The polymer composition may comprise a colorant which is then typically added to the composition in form of a color master batch. Such color master batches may be commercially available or may be prepared in a conventional manner by combining the colorant with a carrier medium. The amount of colorant master batch, if present, is preferably up to 5 wt %, more preferably from 0.1 to 3 wt %, based on the total amount of the polymer composition.

The catalyst (b) can be added to polyolefin (a) as neat (i.e. as provided by the supplier) or in a master batch (MB). In case of the MB the carrier medium can be liquid or solid, for instance a carrier polymer.

The amount of polyolefin (a) in the polymer composition of the invention is typically of at least 35 wt %, preferably of at least 40 wt %, preferably of at least 50 wt %, preferably of at least 75 wt %, more preferably of from 80 to 100 wt % and more preferably of from 85 to 100 wt %, based on the total amount of the polymer component(s) present in the polymer composition. The preferred polymer composition consists of polyolefin (a) as the only polymer components. The expression means that the polymer composition does not contain further polymer components, but the polyolefin (a) as the sole polymer component. However, it is to be understood herein that the polymer composition may comprise further component(s) other than the polyolefin (a) component, such as additive(s) which may optionally be added in a mixture with a carrier polymer in so called master batch. Also the catalyst (b) can be added in form of a master batch, wherein the carrier medium is a polymer. In such cases the carrier polymer of the master batch is not calculated to the amount of the polymer components, but to the total amount of the polymer composition.

The polymer composition of the invention can be produced before or after producing a cable.

In a first embodiment for producing the polymer composition, the polyolefin (a) and the catalyst (b) are combined together before formation of a cable layer. The catalyst (b) can be added as such, i.e. as a neat catalyst (b), or in form of the MB, to the polyolefin (a). The components are preferably combined together by compounding in a conventional manner, e.g. by extruding the components with a screw extruder or a kneader. The obtained meltmixture is preferably pelletised and the pellets of the polymer composition, which can be of any size and shape, are used in the cable production process. Alternatively, in this first embodiment the preparation of the polymer composition or an addition of part of the other component(s) thereof, such as the catalyst (b) or additive(s), or any mixture thereof, can be carried out during the cable production process, e.g. in a cable production line, e.g. in a mixer preceding the cable extruder or in the cable extruder, or in both. The obtained mixture is used to form at least one cable layer.

In a second embodiment, the catalyst (b) is combined together with the polyolefin (a) after the formation of a cable from the polyolefin (a). For instance the catalyst (b) can migrate to a cable layer(s) of polyolefin (a) from another layer adjacent to said layer and thus the polymer composition is formed after the layer production and e.g. before or during the crosslinking of the layer(s).

The first or second embodiment for producing the polymer composition can be chosen depending on the desired cable application of the polymer composition.

End Use of the Polymer Composition

The invention thus provides a cable comprising a polymer composition which comprises a polyolefin (a) and a catalyst (b) as defined above or below.

The preferred cable is a power cable, more preferably a LV, MV or HV cable, which comprises a conductor surrounded by at least one layer comprising, preferably consisting of, a polymer composition which comprises a polyolefin bearing hydrolysable silane groups (a) and a silanol condensation catalyst (b), as defined above or below.

The preferred power cable is selected from a cable (A) comprising a conductor surrounded by at least an insulating layer comprising, preferably consisting of, a polymer composition which comprises a polyolefin (a) and a catalyst (b), as defined above, below or in claims; or a cable (B) comprising a conductor surrounded by an inner semiconductive layer, an insulating layer and an outer semiconductive layer, wherein at least one layer, preferably at least the insulation layer, comprises, preferably consists of, the polymer composition which comprises a polyolefin (a) and a catalyst (b), as defined above, below or in claims.

The cable (A) is preferably a LV or a MV cable. The cable (B) is preferably a MV cable or a HV cable.

In the embodiment of cable (B), the first and the second semiconductive compositions can be different or identical and comprise a polymer(s) which is preferably a polyolefin or a mixture of polyolefins and conductive filler, preferably carbon black. In case of cable (B), preferably, the inner semiconductive layer, the insulating layer and the outer semiconductive layer comprise a polymer composition of the invention. In this case the polyolefin (a) and/or the catalyst (b) of the polymer compositions of the layers can be same or different.

The term "conductor" means herein above and below that the conductor comprises one or more wires. Moreover, the cable may comprise one or more such conductors. Preferably the conductor is an electrical conductor and comprises one or more metal wires.

In the preferred cable of the invention at least the insulation layer comprises the polymer composition.

Insulating layers for medium or high voltage power cables generally have a thickness of at least 2 mm, typically at least 2.3 mm, and the thickness increases with increasing voltage the cable is designed for.

As well known the cable can optionally comprise further layers, e.g. layers surrounding the insulation layer or, if present, the outer semiconductive layers, such as screen(s), a jacketing layer(s), other protective layer(s) or any combinations thereof.

The cable, of the invention is preferably crosslinkable. "Crosslinkable" means that the polymer composition can be crosslinked using the (b) catalyst compound of formula (I) before the use in the end application thereof. Furthermore, the article, preferably the cable, of the invention is crosslinkable and crosslinked before the end use thereof.

Accordingly, preferably a crosslinked cable, is provided, comprising a conductor surrounded by at least one layer, preferably at least an insulation layer, wherein at least said one layer, preferably at least an insulation layer, comprises, preferably consists of, the polymer composition as defined above or in claims which is crosslinked in the presence of the catalyst (b) as defined above or in claims. The crosslinked cable is novel as such, since the layer of the polymer composition contains the residues of the catalyst (b).

The invention further provides a process for producing a cable of the invention as defined above, whereby the process comprises the step of applying on a conductor, preferably by (co)extrusion, one or more layers, wherein at least one layer comprises the polymer composition which comprises (a) a polyolefin bearing hydrolysable silane groups and (b) a silanol condensation catalyst (b), as defined above, below or in claims.

The term "(co)extrusion" means herein that in case of two or more layers, said layers can be extruded in separate steps, or at least two or all of said layers can be coextruded in a same extrusion step, as well known in the art. The term "(co)extrusion" means herein also that all or part of the layer(s) are formed simultaneously using one or more extrusion heads. For instance a triple extrusion can be used for forming three layers. In case a layer is formed using more than one extrusion heads, then for instance, the layers can be extruded using two extrusion heads, the first one for forming the inner semiconductive layer and the inner part of the insulation layer, and the second head for forming the outer insulation layer and the outer semiconductive layer. (Co) extrusion can be effected in any conventional cable extruder, e.g. a single or twin screw extruder.

As well known a meltmix of the polymer composition or component thereof, is applied to form a layer. Meltmixing means mixing above the melting point of at least the major polymer component(s) of the obtained mixture and is carried out for example, without limiting to, in a temperature of at least 15° C. above the melting or softening point of polymer component(s). The meltmixing can be carried out in the cable extruder or in the mixer, e.g. kneader, preceding the extruder, or in both.

The more preferable cable process produces:

(i) a cable (A), wherein the process comprises the steps of applying on a conductor, preferably by (co)extrusion, at least an insulation layer comprising, preferably consisting of, a polymer composition which comprises a polyolefin (a) and a catalyst (b), as defined above, below or in claims; or (ii) a cable (B), wherein the process comprises the steps of applying on a conductor, preferably by (co)extrusion, an inner semiconductive layer comprising a first semiconductive composition, an insulation layer comprising an insulation composition and an outer semiconductive layer comprising a second semiconductive composition, in that order, wherein the composition of at least one layer, preferably at least the insulation composition of the insulation layer comprises, preferably consists of, a polymer composition which comprises a polyolefin (a) and a catalyst (b), as defined above, below or in claims.

In this embodiment of cable (B), the first and the second semiconductive compositions can be different or identical and comprise a polymer(s) which is preferably a polyolefin or a mixture of polyolefins and conductive filler, preferably carbon black.

As well known, the polymer composition of the layer(s) of the cable can be produced before or during the cable production process. Moreover the polymer composition(s) of the layer(s) can each independently comprise part or all of the components of the final composition, before introducing to the (melt)mixing step a) of the cable production process. Then any remaining component(s) are introduced during or after cable formation.

In the preferred cable at least the insulation layer comprises the polymer composition. In this embodiment the polyolefin (a) and the catalyst (b) of the polymer composition are combined according to the first embodiment of the preparation process of the polymer composition as described above, i.e. before the polymer composition is introduced, preferably in pellet form, to the cable production line.

In case one or two of the semiconductive layers of cable (B) comprise the polymer composition, then the polymer composition is preferably prepared according to the second embodiment of the preparation process of the polymer composition as described above, i.e. after the layer formation using polyolefin (a). Then the catalyst (b) can migrate from an adjacent layer, typically insulation layer, to the formed semiconductive layer.

The cable production process of the invention comprises preferably a further step of crosslinking the produced cable. According to a preferred embodiment of said process a crosslinked cable is produced, wherein the process comprises a further step of crosslinking the obtained at least one layer comprising a polymer composition as defined above or below. The crosslinking is carried out in the presence of the catalyst (b) and water, also called as moisture curing. Water can be in form of a liquid or vapour, or a combination thereof. The silane groups present in the polyolefin (a) are hydrolysed under the influence of water in the presence of the present silanol condensation catalyst (b) resulting in the splitting off of alcohol and the formation of silanol groups, which are then crosslinked in a subsequent condensation reaction wherein water is split off and Si—O—Si links are formed between other hydrolysed silane groups present in said polyolefin (a). The crosslinked polymer composition has a typical network, i.a. interpolymer crosslinks (bridges), as well known in the field. Usually, moisture curing is performed in ambient conditions or in a so called sauna or water bath at temperatures of 70 to 100° C.

Moreover, the cable production process preferably comprises a further step of (i) crosslinking the insulation composition of the insulation layer of the cable (A) in the presence of a catalyst (b) as defined above or below and water, or (ii) crosslinking at least one of the insulation composition of the insulation layer, the first semiconductive composition of the inner semiconductive layer or the second semiconductive composition of the outer semiconductive layer of the cable (B), preferably crosslinking at least the insulation composition of the insulation layer, more preferably crosslinking the insulation composition of the insulation layer and at least one of the first semiconductive composition of the inner semiconductive layer and the second semiconductive composition of the outer semiconductive layer, more preferably crosslinking the insulation composition of the insulation layer, the first semiconductive composition of the inner semiconductive layer, and, optionally, and preferably, the second semiconductive composition of the outer semiconductive layer, in the presence of a catalyst (b) as defined above or below and water.

In case of cable (B), the outer semiconductive layer can be bonded (non-strippable) or strippable, which terms have a well known meaning. The bonded outer semiconductive layer is typically crosslinked. The strippable outer semiconductive layer is typically not crosslinked.

Accordingly, in case of cable (B), preferably, the inner semiconductive layer, the insulating layer and optionally the outer semiconductive layer, depending whether bonded or strippable, are crosslinked.

A crosslinked cable obtainable by the process is also provided.

Furthermore, the invention provides a use of a catalyst (b) as defined above or below for crosslinking a polyolefin (a) as defined above or below, more preferably for crosslinking at least one layer of a cable comprising the polyolefin (a) as defined above or below.

Determination Methods

Wt %: % by weight

Total amount means weight, if in %, then 100 wt %. E.g. the total amount (100 wt %) of the polymer composition.

Melt Flow Rate

The melt flow rate (MFR) is determined according to ISO 1133 and is indicated in g/10 min. The MFR is an indication of the flowability, and hence the processability, of the polymer. The higher the melt flow rate, the lower the viscosity of the polymer. The MFR is determined at 190° C. for polyethylene. MFR may be determined at different loadings such as 2.16 kg ($MFR_2$) or 21.6 kg ($MFR_{21}$).

Density

Low density polyethylene (LDPE): The density was measured according to ISO 1183-2. The sample preparation was executed according to ISO 1872-2 Table 3 Q (compression moulding).

Low pressure process polyethylene: Density of the polymer was measured according to ISO 1183/1872-2B.

Gel Content

Tape samples as prepared below in experimental part under "Tape sample preparation" were used to determine the gel content according to ASTM D 2765-01, Method B, using decaline extraction, with the following two deviations from this standard:

1) An addition extraction for 1 hour with new decaline was done in order to secure that all solubles were extracted.

2) Only 0.05% antioxidant (Irganox 1076) was added to the decalin instead of 1% as specified in the standard.

The gel content was then calculated according to said ASTM D 2765-01.

Hot Set Elongation Test

Tape samples as prepared below in experimental part under "Tape sample preparation" were used to determine the hot set properties. Three dumb-bells sample, taken out along extrusion direction were prepared according to ISO527 5A from the 1.8+−0.1 mm thick crosslinked tape. The hot set test were made according to EN60811-2-1 (hot set test) by measuring the thermal deformation.

Reference lines, were marked 20 mm apart on the dumb-bells. Each test sample was fixed vertically from upper end thereof in the oven and the load of 0.2 MPa are attached to the lower end of each test sample. After 15 min, 200° C. in oven the distance between the pre-marked lines were measured and the percentage hot set elongation calculated, elongation %. For permanent set %, the tensile force (weight) was removed from the test samples and after recovered in 200° C. for 5 minutes and then let to cool in room temperature to ambient temperature. The permanent set % was calculated from the distance between the marked lines The average of the three test were reported.

Crosslinking Performance of a Melt Polymer Sample

The method is shows the crosslinking capability of a silanol condensation catalyst on a polyolefin having hydrolysable silane groups in presence of water.

By measuring continuously the torque of the rotors in a 287 $cm^3$ Brabender mixer during crosslinking at 120° C. of a melt of polyolefin bearing hydrolysable silane groups, silanol condensation catalyst and water, it is possible to measure the crosslinking activity of the catalyst. The activity of the catalyst is directly linked to the increase in momentum. The method is described below in more details.

Sample and Measurement Procedure

The polyolefin bearing hydrolysable silane groups and catalyst should be dry and have room temperature. The density of the polyolefin bearing hydrolysable silane groups is measured using a suitable method as described above under "Density".

The weight (amount) of base resin to be added to the chamber is calculated by using following formula:

$$Wb=Db\times 287\ cm^3, \text{ where}$$

Wb=Weight of the polyolefin bearing hydrolysable silane groups (g).

Db=Density of the polyolefin bearing hydrolysable silane groups. ($g/cm^3$).

The pellets of polyolefin bearing hydrolysable silane groups are the weighted accordingly. The oil heated Brabender mixer is adjusted to 120° C.+−2° C. The rotor speed is adjusted to 5 RPM.

The pellets of the polyolefin bearing hydrolysable silane groups are added stepwise to the Brabender mixer so that all the pellets melt. The chamber after the addition is almost filled with melt. The catalyst to be tested is added then to the Brabender mixer. The polyolefin bearing hydrolysable silane groups and silanol condensation catalyst are dispersed together for 5 min, during which time the temperature and the momentum base line stabilize. Then 20 g of water is added in form of crushed ice, which made from deionised water and packed in a small polyethylene plastic bag into the Brabender mixer. The polyolefin bearing hydrolysable silane groups and the water reacts (crosslinks) in presence of silanol condensation catalyst, whereby, as a consequence, the torque increases.

The time, temperature and torque are recorded is registered on the plotter until the cure is completed or for a maximum time of 2 h.

The torque difference DF is calculated from the curve as follows:

$$DF=F\max-F\min$$

DF=Torque difference (Nm)

Fmax=max Torque measured from the curve.

Fmin=The stable minimum torque from the base line before adding the ice.

The speed of crosslinking is calculated as follows:

$$Vx=DF/(T\max-T\min)$$

Vx=crosslinking speed (Nm/s)

Tmax: Time to achieve Fmax(s)

Tmin: Time to Tmin (s).

Content (Wt % and Mol %) of Polar Comonomer:

Comonomer content (Wt %) of the polar comonomer was determined in a known manner based on Fourier transform infrared spectroscopy (FTIR) determination calibrated with $^{13}C$-NMR as described in Haslam J, Willis H A, Squirrel D C. Identification and analysis of plastics, $2^{nd}$ ed. London Iliffe books; 1972. FTIR instrument was a Perkin Elmer 2000, 1 scann, resolution 4 $cm^{-1}$.

For determination of the comonomers, films with thickness 0.1 mm were prepared. The peak for the used comonomer was compared to the peak of polyethylene as evident for a skilled person (e.g. the peak for butyl acrylate at 3450 $cm^{-1}$ was compared to the peak of polyethylene at 2020 $cm^{-1}$). The weight-% was converted to mol-% by calculation based on the total moles of polymerisable monomers.

Content (Mol-%) of Hydrolysable Silane Group(s) ($Si(Y)_{3-q}$) Using X-Ray Fluorescence Analysis:

The pellet sample was pressed to a 3 mm thick plaque (150° C. for 2 minutes, under pressure of 5 bar and cooled to room temperature). Si-atom content was analysed by wavelength dispersive XRF (AXS S4 Pioneer Sequential X-ray Spectrometer supplied by Bruker). The pellet sample was pressed to a 3 mm thick plaque (150° C. for 2 minutes, under pressure of 5 bar and cooled to room temperature).

Generally, in XRF- method, the sample is irradiated by electromagnetic waves with wavelengths 0.01-10 nm. The elements present in the sample will then emit fluorescent X-ray radiation with discrete energies that are characteristic for each element. By measuring the intensities of the emitted energies, quantitative analysis can be performed. The quantitative methods are calibrated with compounds with known concentrations of the element of interest e.g. prepared in a Brabender compounder.

The XRF results show the total content (wt %) of Si and are then calculated and expressed herein as Mol %-Content of hydrolysable silane group(s) ($Si(Y)_{3-q}$).

Experimental Part

Preparation of Examples

Base Polyolefin (a)

Polyolefin I:

A conventional high density homopolymer of polyethylene produced in a low pressure polymerisation process and grafted with VTMS. VTMS content in the polymer of 1.8 wt %, $MFR_5$ of 2-4 and density of 958 kg/m.

Polyolefin II:

Commercially available copolymer of ethylene with vinyl trimethoxy silane (VTMS) comonomer, LE4423, supplier Borealis, VTMS content of the copolymer of 1.35 wt % (0.26 mol %), $MFR_2$ of 1.0 g/10 min (190° C./2.16 kg) and density of 923 kg/$m^3$, produced the high pressure polymerisation, in a tubular reactor.

Polyolefin III:

Commercially available copolymer of ethylene with vinyl trimethoxy silane (VTMS) comonomer, LE4421, supplier Borealis, VTMS content of the copolymer of 1.8 wt % (0.35 mol %), $MFR_2$ of 1.0 g/10 min (190° C./2.16 kg) and density of 923 kg/$m^3$, produced the high pressure polymerisation, in a tubular reactor.

Polyolefin IV:

Ethylene 3-methacryloxypropyl trimethoxy silane copolymers (table 1) were produced at 230° C. and 190 MPa in a stirred (1200 rpm) high pressure autoclave reactor (0.16 $m^3$). The reactor jacket was heated externally to a temperature of 150° C. Chain Transfer Agent (CTA), initiators and comonomer were added in a conventional manner to the ethylene in the reactor system. Propion aldehyde was used as CTA and as the initiators t-butyl peroxypivalate (Luperox 11 M75), t-butyl peroxyacetate (Luperox 7M50) and t-butylperoxy 2-ethylhexanoate (Luperox 26) were used. $MFR_2$ of 1.0 g/10 min (190° C./2.16 kg) was adjusted by addition of propion aldehyde as chain transfer agent in a manner known to a skilled person.

TABLE 1

| Polymer | Co-monomer content (wt %) | Co-monomer content (mol/kg polymer) | $MFR_2$ |
|---|---|---|---|
| Polyolefin IV | 2.88 | 0.058 | 2.42 |

Reference Master Batch:

Commercially available master batch of silane condensation catalyst LE4476, wherein the active catalyst component is based on sulfonic acid, supplied by Borealis.

Inventive Catalysts:

Inventive Catalyst 1:

1,8-Diazabicyclo [5.4.0] undec-7-ene (DBU), Mw of 152 g/mol, CAS-nr: 6674-22-2, Supplier Sigma-Aldrich

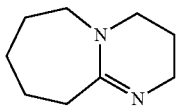

Inventive Catalyst 2:

1,5-Diazabicyclo [4.3.0] no-5-ene (DBN), Mw of 124 g/mol, CAS-nr: 3001-72-7, Suplier Sigma-Aldrich

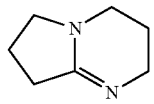

Inventive Catalyst 3:

2-tert-Butyl-1,1,3,3-tetramethylguanidine, Mw of 171 g/mol CAS-nr: 29166-72-1, supplier Sigma-Aldrich

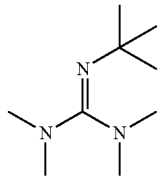

Inventive Catalyst 4:

2,4,6-Tris[bis(methoxymethyl)amino]-1,3,5-triazine also known as hexamethoxymethyl melamine, Mw of 390 g/mol, CAS-nr: 68002-20-0, supplier Cytec.

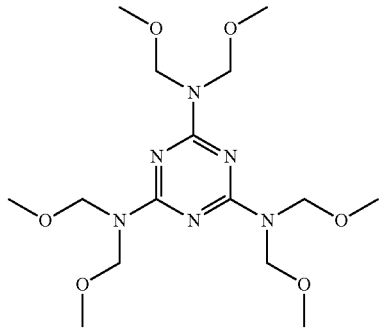

Inventive Catalyst 5:

1,2-Bis(2-aminoethoxy)ethane, Mw of 148 g/mol, CAS: 929-59-9, supplier Huntsman

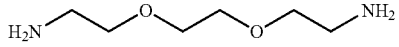

Inventive Master Batch Preparation:

Inventive master batch 1, inventive master batch 2 and inventive master batch 3 were prepared by compounding the inventive catalyst 1, the inventive catalyst 2 and, respectively, inventive catalyst 3 with the same conventional ethylene butyl acrylate copolymer (butyl acrylate, BA, content 17 wt %) as used for the reference MB. The obtained inventive master batch 1 contained 0.95 wt % of the inventive catalyst 1, the obtained inventive master batch 2 contained 0.8 wt % of the inventive catalyst 2 and the obtained inventive master batch 3 contained 1.05 wt % of the inventive catalyst 3.

Inventive catalyst 4 and inventive catalyst 5 were used as such for the below described Ice Test, i.e. added as neat to the test polymer pellets in the Brabender mixer, as described above in Ice Test under "Determination methods".

Tape Sample Preparation:

Tape samples were prepared by conventional compounding, i.e. meltmixing, the test polyolefin (a) together with the inventive master batch 1, inventive master batch 2, inventive master batch 3 or, respectively, reference master batch in a tape extruder (Collin Teach-Line Extruder, Type: E 20 T SCD 15, settings disclosed in table 2) and in amounts to obtain a test or reference polymer composition containing the inventive catalyst or, respectively, the reference catalyst in an amounts as given below in tables.

TABLE 2

Compounding conditions

| Set Values Temperature [° C.] | | | | | | Extruder | |
|---|---|---|---|---|---|---|---|
| Zon 1 | Zon 2 | Zon 3 | Zon 4 | Zon 5 | Zon 6 | Speed [rpm] | Output [kg/h] |
| 60 | 150 | 160 | 170 | 170 | 170 | 30 | 0.8 |

The obtained tape samples (with 1.8±0.1 mm in thickness) were used for crosslinking and for determining gel content and hot set.

Crosslinking of inventive compositions was effected in two different conditions: either the obtained tape sample was kept in water bath at 90° C. or in ambient conditions, at 23° C. and 50% relative humidity, and let crosslinking to occur for different time periods as specified in the below tables. Accordingly, hot set elongation was measured after crosslinking 24 h in water bath at 90° C. and after 7 days and 14 days in ambient conditions at 23° C.

The components and their amounts of the inventive and reference compositions, the crosslinking conditions and period, as well as the results of the measurements are given in table 3.

TABLE 3

Catalytic effect of the Inventive composition 1 compared to Reference composition 1

| | Hot set 24 h[1,3] | Hot set 7 days[2,3] | Hot set 14 days[2,3] |
|---|---|---|---|
| Inv. Comp. 1 (3 mmol/kg of Inventive catalyst 1 in Polyolefin I) | 35.4 | 60.4 | 38.8 |
| Inv. Comp. 2 (3 mmol/kg of Inventive catalyst 2 in Polyolefin I) | 39.5 | 71.9 | 48.3 |
| Ref. Comp. 1 (2.3 mmol/kg of ref. catalyst in Polyolefin II) | 34.3 | 56.2 | 39.9 |

[1]Crosslinking in water bath at 90° C., for the specified time period.
[2]Crosslinking in ambient conditions at 23° C. for the specified time period.
[3]Hot Set measured is Hot Set Elongation Inv. Comp. 3 (3 mmol/kg of Inventive catalyst 3 in Polyolefin I had a hot set 24 h[1,3] of 97.5, which demonstrates the crosslinking behaviour of the catalyst Crosslinking Performance Using Ice and Measuring the Torque of Inventive Compositions 4 and 5 (=Crosslinking Performance of a Melt Polymer Sample Under Determination Methods)

All samples were done according to the method described above.

TABLE 4

Crosslinking performance of the Inventive catalyst 1, 4 and 5

| | Amount of catalyst used in Polyolefin III mmol/kg polyolefin III | Amount of catalyst used in Polyolefin IV mmol/kg polyolefin IV | Δ torque Nm | Cross linking speed Nm/s |
|---|---|---|---|---|
| Inventive catalyst 4 | 7.7 | N/A | 23.2 | 0.69 |
| Inventive catalyst 5 | 27 | N/A | 13.6 | 0.21 |
| Inventive catalyst 1 | N/A | 3.3 | 50.2 | 0.27 |
| Reference Polyolefin (Polyolefin II without any catalyst) | 0 | 0 | 0 | 0 |

What is claimed is:

1. A process for producing a cable comprising a conductor surrounded by at least one layer comprising a polymer composition which comprises (a) a polyolefin bearing hydrolysable silane groups and (b) a silanol condensation catalyst compound, wherein the silanol condensation catalyst compound (b) is an organic compound which comprises at least one nitrogen atom containing moiety, wherein said nitrogen atom containing moiety is other than a secondary amine moiety and wherein the organic compound has a molecular weight of less than 2000 g/mol, and wherein the silanol condensation catalyst compound (b) catalyzes crosslinking of silane groups via hydrolysis, and subsequent condensation reaction occurs in the presence of the silanol condensation catalyst compound (b);

the process comprises adding the silanol condensation catalyst compound (b) to the polyolefin to produce the polymer composition;

wherein the polyolefin is a polyethylene;

wherein the process further comprises:

(i) applying on a conductor at least an insulation layer comprising the polymer composition; or (ii) applying on a conductor an inner semiconductive layer comprising a first semiconductive composition, an insulation layer comprising an insulation composition, and an outer semiconductive layer comprising a second semiconductive composition, wherein, one of the inner semiconductive layer, the insulation layer, and the outer semiconductive layer comprises the polymer composition;

wherein the silanol condensation catalyst compound (b) is selected from compounds of formula (Ia3) or (IIIa2):

a compound of formula (Ia3) comprising:

(Ia3)

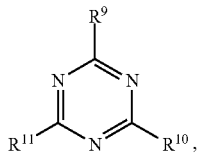

wherein each $R^9$, $R^{10}$ and $R^{11}$ are independently is H, or an optionally substituted saturated or partially unsaturated hydrocarbyl which optionally contains one or more heteroatom(s) selected from (i) an optionally substituted linear or branched, saturated or partially unsaturated hydrocarbyl group; (ii) an optionally substituted linear or branched, saturated or partially unsaturated hydrocarbyl group which bears a saturated or partially unsaturated cyclic hydrocarbyl moiety or an optionally substituted linear or branched, saturated or partially unsaturated hydrocarbyl group which bears an aromatic hydrocarbyl moiety; or (iii) an optionally substituted saturated or partially unsaturated cyclic hydrocarbyl group; wherein, when present, the cyclic hydrocarbyl group of (iii) or the saturated or partially unsaturated cyclic hydrocarbyl moiety in the hydrocarbyl group of (ii) contains from 5 to 15 ring atoms; or a compound of formula (IIIa2) comprising:

$$(R^{13})_2N—(CH_2)_w—O—(CH_2)_p—O—(CH_2)_k—N(R^{14})_2 \quad \text{(IIIa2)},$$

wherein w+p+k=3 to 20; and each $R^{13}$ and each $R^{14}$ is independently H or an unsubstituted linear or branched (C1-C30)alkyl group'.

2. The process according to claim 1 further comprising:

(i) crosslinking the polymer composition in the presence of water.

3. The process of claim 1 wherein the at least one layer is selected from an insulation layer, a semiconductive layer or a jacketing layer.

4. The process of claim 1, wherein the cable is a power cable comprising a conductor surrounded at least by an inner semiconductive layer, an insulating layer and an outer semiconductive layer, wherein at least one of the inner semiconductive layer, the insulating layer, and the outer semiconductive layer comprises said polymer composition.

5. The process according to claim 1, wherein said at least one layer is an insulation layer.

6. The process according to claim 1, wherein, when present in the silanol condensation catalyst compound (b), the substituted or unsubstituted aromatic hydrocarbyl group as the substituent $R^9$, $R^{10}$ or $R^{11}$, as a moiety in the substituent $R^9$, $R^{10}$ or $R^{11}$ of the compounds (Ia3) is a mono or multicyclic aryl which has 6 to 12 ring atoms, which may optionally bear one or more substituents and which may optionally contain one or more heteroatom(s).

7. The process according to claim 1, wherein the one or more optional heteroatom(s) are at least one of N, O, P and S.

8. The process according to claim 1, wherein, when present in the silanol condensation catalyst compound (b), the further substituent(s) comprise a pendant group having 1 to 4 functional group(s), wherein the functional group(s) are selected from at least one of —OH, —$NH_2$, =NH, nitro, thiol, thio$C_{1-12}$alkyl, CN or halogen, —F, —Cl, —Br, —I, —COR', —CONR'$_2$, —COOR', wherein each R' is H or (C1-C12)alkyl, and wherein the cyclic hydrocarbyl group of (iii) or the hydrocarbyl group of (ii); or any aromatic hydrocarbyl as the substituent or as the moiety in the hydrocarbyl group of (ii) may optionally bear an optionally substituted linear or branched, saturated or partially unsaturated hydrocarbyl group of (i).

9. The process according to claim 1, wherein the silanol condensation catalyst compound (b) is a compound of formula (Ia3).

10. The process according to claim 1, wherein the silanol condensation catalyst compound (b) is present in an amount of 0.0001 to 6.0 wt %, based on a combined amount of the polyolefin bearing hydrolysable silane groups (a) and the silanol condensation catalyst compound (b).

11. The process according to claim 1, wherein the polyolefin bearing hydrolysable silane groups (a) is a copolymer of ethylene with a silane group(s) bearing comonomer, and, optionally, with other comonomer(s); or is a homopolymer or copolymer of ethylene with silane groups which are introduced by grafting a silane group(s) containing compound to the polyethylene polymer.

12. The process according to claim 1, wherein the polyolefin bearing hydrolysable silane groups (a) is a polyethylene produced in the presence of an olefin polymerisation catalyst or a polyethylene produced in a high pressure, which bears hydrolysable silane groups.

13. The process according to claim 11, wherein the silane group(s) bearing comonomer or compound is a compound of formula (IV), $$R^1SiR^2_qY_{3-q} \quad \text{(IV)}$$

wherein $R^1$ is an ethylenically unsaturated hydrocarbyl, hydrocarbyloxy or (meth)acryloxy hydrocarbyl group, $R^2$ is an aliphatic saturated hydrocarbyl group, Y which may be the same or different, is a hydrolysable organic group and q is 0, 1 or 2.

14. The process according to claim 1, wherein the polymer composition further comprises a hydrolysable silane group(s) in an amount of from 0.001 to 12 mol %, based on the total amount of the polymer composition.

15. The process according to claim 1, wherein the silanol condensation catalyst compound (b) is a compound of formula (IIIa2).

16. The process according to claim 1, wherein the silanol condensation catalyst compound (b) is a compound with the structure:

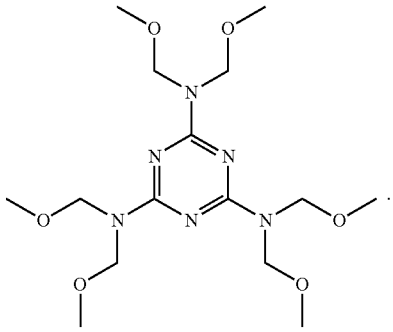

17. The process according to claim 1, wherein the silanol condensation catalyst compound (b) is a compound with the structure:

$$H_2N—(CH_2)_2—O—(CH_2)_2—O—(CH_2)_2—NH_2.$$

* * * * *